US012741184B2

(12) United States Patent
Jergensen et al.

(10) Patent No.: US 12,741,184 B2
(45) Date of Patent: Sep. 22, 2026

(54) POLE STRUCTURE, POLE ASSEMBLY SYSTEM AND METHOD THEREOF

(71) Applicant: Sky Products, L.L.C., Bountiful, UT (US)

(72) Inventors: Jace B. Jergensen, Bountiful, UT (US); Gaylen W. Ercanbrack, Plymouth, MA (US)

(73) Assignee: Sky Products, L.L.C., Bountiful, UT (US)

( * ) Notice: Subject to any disclaimer, the term of this patent is extended or adjusted under 35 U.S.C. 154(b) by 207 days.

(21) Appl. No.: 18/803,358

(22) Filed: Aug. 13, 2024

(65) Prior Publication Data

US 2025/0099829 A1 Mar. 27, 2025

Related U.S. Application Data

(60) Provisional application No. 63/539,770, filed on Sep. 21, 2023.

(51) Int. Cl.

| | |
|---|---|
| ***A63B 63/08*** | (2006.01) |
| ***E04H 12/18*** | (2006.01) |
| ***E04H 12/34*** | (2006.01) |

(52) U.S. Cl.

CPC ..... *A63B 63/083* (2013.01); *E04H 12/187* (2013.01); *E04H 12/345* (2013.01)

(58) Field of Classification Search

CPC .... A63B 63/083; E04H 12/187; E04H 12/345
USPC ..... 273/402
See application file for complete search history.

(56) References Cited

U.S. PATENT DOCUMENTS

| | | | | |
|---|---|---|---|---|
| 2,364,851 | A | 12/1944 | Johansen | |
| 2,985,261 | A | 5/1961 | Kubesh | |
| 4,473,975 | A | 10/1984 | Golay | |
| 4,903,442 | A | 2/1990 | Trommen | |
| 5,098,092 | A * | 3/1992 | Aakre | A63B 63/083 473/483 |
| 5,603,496 | A | 2/1997 | Rappaport | |
| 5,695,417 | A | 12/1997 | Winter et al. | |
| 5,720,679 | A | 2/1998 | Schroeder | |
| 5,772,167 | A | 6/1998 | Koole | |

(Continued)

FOREIGN PATENT DOCUMENTS

| | | |
|---|---|---|
| KR | 100940735 | 2/2010 |
| KR | 101131020 | 3/2012 |

*Primary Examiner* — Jacob K Ackun
(74) *Attorney, Agent, or Firm* — David L. Stott

(57) ABSTRACT

A basketball goal including a lower pole, an upper pole, a backboard and a rim. The lower pole extends from a base and extends with a lower pole hinge adjacent one end of the lower pole. The upper pole includes an upper pole hinge, the upper pole hinge configured to be coupled to the lower pole hinge with a pin to facilitate pivotably coupling the upper pole to the lower pole. The backboard is configured to be coupled to the upper pole, and the rim is configured to be coupled to the backboard. The pivotable coupling between the lower and upper poles is for assisting assembly of the basketball goal with an assembly system such that, upon assembling the basketball goal, the upper pole is fixated in an upright position with the lower pole. Also, a light pole may be assembled with a hinged coupling, similar to the basketball goal.

36 Claims, 19 Drawing Sheets

(56) References Cited

U.S. PATENT DOCUMENTS 5,893,809 A * 4/1999 Coats ..... A63B 63/083 473/486
6,077,177 A 6/2000 Winter et al.
6,120,396 A 9/2000 Van Nimwegen et al.
6,142,891 A 11/2000 Winter et al.
6,179,733 B1 1/2001 Story
6,273,834 B1 8/2001 Winter
6,283,878 B1 9/2001 White
6,302,811 B1 10/2001 Topham
6,419,598 B1 7/2002 Winter et al.
6,422,957 B1 7/2002 Winter et al.
6,488,599 B2 12/2002 Nye
6,626,773 B1 9/2003 Fair
6,699,146 B1 3/2004 Winter et al.
6,790,151 B2 9/2004 Wilson et al.
6,837,810 B1 1/2005 McAllister et al.
6,848,661 B2 2/2005 Baldasari
6,884,189 B2 4/2005 Fair
7,089,705 B1 8/2006 Lieberman
7,097,574 B2 8/2006 Nye et al.
7,393,293 B2 7/2008 Guerzini et al.
7,462,117 B2 12/2008 White et al.
8,062,152 B2 11/2011 Nye et al.
8,348,788 B2 1/2013 Nye et al.
8,598,724 B2 12/2013 Ulanovskiy
8,910,432 B2 12/2014 Egan et al.
9,333,406 B1 5/2016 Weeder
10,004,963 B2 6/2018 Crosby et al.
10,022,604 B2 7/2018 Elpers
2003/0171171 A1 9/2003 Fair
2004/0266567 A1* 12/2004 O'Neill ..... A63B 63/083 473/481
2005/0064962 A1 3/2005 Pile
2005/0192126 A1* 9/2005 Remaklus ..... A63B 63/083 473/448
2007/0010356 A1 1/2007 Moller, Jr.
2009/0105016 A1* 4/2009 White ..... A63B 71/0054 473/483
2011/0271608 A1 11/2011 Egan et al.
2011/0272190 A1 11/2011 Rouse et al.
2012/0028740 A1 2/2012 Nye et al.
2017/0234024 A1* 8/2017 Hardie ..... E04H 12/2276 362/431

* cited by examiner

POLE STRUCTURE, POLE ASSEMBLY SYSTEM AND METHOD THEREOF

CROSS-REFERENCE TO RELATED APPLICATIONS

This application claims the benefit of U.S. Provisional Application No. 63/539,770, filed Sep. 21, 2023, the disclosure of which is hereby incorporated by reference herein in its entirety.

TECHNICAL FIELD

The present invention relates generally to pole structures and, more specifically, the present invention relates to pole structures and the assembly of pole structures.

BACKGROUND

Basketball courts, pickleball courts, volleyball courts and tennis courts are often located in parks and residences or the like. Such courts typically include lighting for use of the courts in the evening and night hours. The lighting as well as basketball goals typically include long pole structures. For example, basketball goals typically will include a long pole that may extend anywhere between 8 feet and 12 feet long as well as include a backboard and rim for connecting to the pole. Pole structures for lighting purposes may extend anywhere between 10 feet and 20 feet or longer and will typically include a light structure, such as an LED type lighting, positioned adjacent one end of the pole structure. The assembly of the basketball goals as well as light poles is difficult to implement with one person and can even be difficult for multiple people due to the long length and weight of the components to assemble basketball goals as well as light poles. As such, it would be advantageous to simplify the assembly process of such pole structures.

BRIEF SUMMARY OF THE INVENTION

The present invention is directed to various embodiments of a pole system and a pole assembly system. In one embodiment, the pole system is a basketball system configured to be coupled to a cement pad. The basketball system includes a lower pole, an upper pole, a backboard and a rim. The lower pole extends from a base portion such that the base portion is configured to be coupled to the cement pad. The lower pole includes a lower pole hinge positioned adjacent one end of the lower pole. The upper pole includes an upper pole hinge, the upper pole hinge configured to be coupled to the lower pole hinge with a pin to facilitate temporarily pivotably coupling the upper pole to the lower pole. The backboard is configured to be coupled to the upper pole. The rim is configured to be coupled to the backboard.

In another embodiment, upon the upper pole moving from a pivot position to an upright vertical position, the upper pole is configured to be fixated to the lower pole in a non-pivotable manner so that the lower pole and the upper pole both extend vertically upright. In another embodiment, the upper pole is fixated to the lower pole to form a single vertically extending pole, the upper pole fixated to the lower pole at an intermediate position along a height of the single vertically extending pole, the intermediate position being within the range of between about two feet and about eight feet from the cement pad.

In another embodiment, the basketball system further includes link arms extending between a first end portion and a second end portion, the first end portion pivotably coupled to the upper pole and the second end portion coupled to the backboard. In another embodiment, the basketball system further includes a height actuator, the height actuator coupled to the link arms and one of the upper pole and the lower pole, the height actuator configured to pivot the link arms relative to the upper pole to change a height of the rim relative to the cement pad. In another embodiment, the upper pole includes a first upper pole portion and a second upper pole portion, the first upper pole portion extending straight and the second upper pole portion extending with at least one bend or at least one curved portion.

In accordance with another embodiment of the present invention, a pole assembly system for assembling a vertically extending pole, the pole including an upper pole configured to be pivotably coupled to a lower pole such that the lower pole includes a base portion configured to be fixed to a cement base is provided. The pole assembly system includes a lever arm and a lifting device. The lever arm is coupled to the upper pole. The lifting device is coupled to the base portion of the lower pole. Further, the lifting device is coupled to the lever arm with a line such that, upon actuating the lifting device, the lifting device is configured to lift the upper pole from a pivoted position to a vertical use position so that the upper pole is positioned vertically relative to the lower pole.

In another embodiment, the lever arm is removably coupled to the upper pole. In another embodiment, the lifting device is actuated with a motor associated with the lifting device. In still another embodiment, the lifting device is manually actuated with a hand crank. In another embodiment, the lever arm extends with at least one bend along a length thereof. In still another embodiment, the lever arm is configured to be coupled to the upper pole so that the lever arm extends over and beyond a pivot axis defined between the upper pole and the lower pole. In another embodiment, the lifting device includes a winch device or a hoist device.

In accordance with another embodiment of the present invention, a method for assembling a pole system to a cement pad is provided. The method includes the steps of: providing a pole system including an upper pole configured to be pivotably coupled to a lower pole such that the lower pole includes a base portion configured to be coupled to the cement pad; securing the base portion and the lower pole to the cement pad such that the lower pole extends in a vertical upright position from the cement pad; pivotably coupling the upper pole to the lower pole; coupling a lifting device to the base portion of the lower pole; coupling a lever arm to the upper pole with the upper pole being in a pivoted position relative to the lower pole; coupling a line of the lifting device to the lever arm; and actuating the lifting device to pivot the upper pole toward the lower pole with the line such that the lifting device and line move the upper pole from the pivoted position toward a vertical use position.

In another embodiment, the actuating the lifting device step includes pivoting the upper pole to an intermediate position to connect a first end portion of link arms to the upper pole and a second end portion of the link arms to a backboard. In another embodiment, the actuating the lifting device step includes pivoting the upper pole to another intermediate position to connect a rim to the backboard. In another embodiment, the method includes a further step of connecting a height actuator between one of the upper pole and lower pole and one of the link arms. In another embodiment, the actuating the lifting device step includes pivoting the upper pole to extend vertically from the lower pole in the vertical upright position for securing the upper pole to the lower pole to be maintained in the vertical upright position. In still another embodiment, the method further includes the step of removing the lever arm and the lifting device from the pole system. In another embodiment, the actuating the lifting device step includes pivoting the upper pole to an intermediate position to connect a backboard to the upper pole, and pivoting the upper pole to another intermediate position to connect a rim to the backboard. In another embodiment, the actuating the lifting device step includes pivoting the upper pole to an intermediate position to connect a light member to the upper pole. In yet another embodiment, the actuating the lifting device step includes actuating the lifting device with a motor associated therewith. In another embodiment, the actuating the lifting device step includes manually actuating the lifting device with a hand crank associated therewith. In another embodiment, the coupling of the lever arm step includes coupling the lever arm with at least one bend along a length of the lever arm.

In accordance with another embodiment of the present invention, a pole assembly system for securement to a cement pad is provided. The pole assembly system includes a pole assembly, a lever arm, and a lifting device. The pole assembly includes an upper pole and a lower pole, the lower portion including a base portion such that the base portion is configured to be coupled to the cement pad. The lower pole is configured to extend from the base portion such that the lower pole extends in an upright vertical position, the upper pole configured to be pivotably coupled to the lower pole. The lever arm is configured to be coupled to the upper pole. The lifting device is configured to be coupled to the base portion of the lower pole. The lifting device is coupled to the lever arm with a line such that, upon actuating the lifting device, the lifting device is configured to lift the upper pole from a pivoted position to a vertical use position so that the upper pole is positioned vertically relative to the lower pole.

In another embodiment, the pole assembly further includes link arms, a backboard, a rim, and a height actuator, the link arms configured to be coupled to the upper pole and the backboard, the rim configured to be coupled to the backboard, and the height actuator configured to be coupled to the upper pole and at least one link arm. In another embodiment, the pole assembly further includes a backboard and a rim, the backboard configured to be coupled to the upper pole, and the rim configured to be coupled to the backboard. In another embodiment, the pole assembly further includes a light member. In still another embodiment, the lifting device is manually actuated with a hand crank. In another embodiment, the lever arm is removably coupled to the upper pole with a strap. In another embodiment, the lever arm extends with at least one bend along a length thereof. In still another embodiment, the lever arm is configured to be coupled to the upper pole so that the lever arm extends over and beyond a pivot axis defined between the upper pole and the lower pole. In another embodiment, the lifting device includes a winch device or a hoist device.

In accordance with another embodiment of the present invention, a light pole configured to be coupled to a cement pad is provided. The light pole includes a lower pole, an upper pole and a light fixture. The lower pole extends between a base end and an upper end, the base end secured to the cement pad so that the lower pole is fixed in a substantially vertical position. The lower pole includes a lower pole hinge adjacent to the upper end of the lower pole. The upper pole extends between first and second ends, the upper pole having an upper pole hinge positioned adjacent to the first end of the upper pole. The upper pole hinge is configured to be coupled to the lower pole hinge with a pin to facilitate temporarily pivotably coupling the upper pole to the lower pole. The light fixture is operably coupled to the upper pole.

In another embodiment, the light pole further includes a second upper pole that extends between opposing ends, one end of the second upper pole coupled to the second end of the upper pole and another one end of the second upper pole coupled adjacent the light fixture. In another embodiment, the light pole further includes a second upper pole and an extension member, the second upper pole configured to be coupled to the second end of the upper pole, the extension member coupled to one end of the second upper pole and extending transverse relative to the second upper pole, the light fixture being coupled to the extension member. In another embodiment, the light pole further includes an extension member coupled to the second end of the upper pole and extending transverse relative to the upper pole, the light fixture coupled to the extension member. In another embodiment, the lower pole includes inner flange portions extending from adjacent the upper end of the lower pole and configured to be positioned within the upper pole adjacent the first end of the upper pole, wherein, upon pivoting the upper pole from a pivoted position to an upright position, the upper pole is configured to be coupled to the inner flange portions of the lower pole so that the upper pole is fixed in an upright position with the vertically positioned lower pole.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
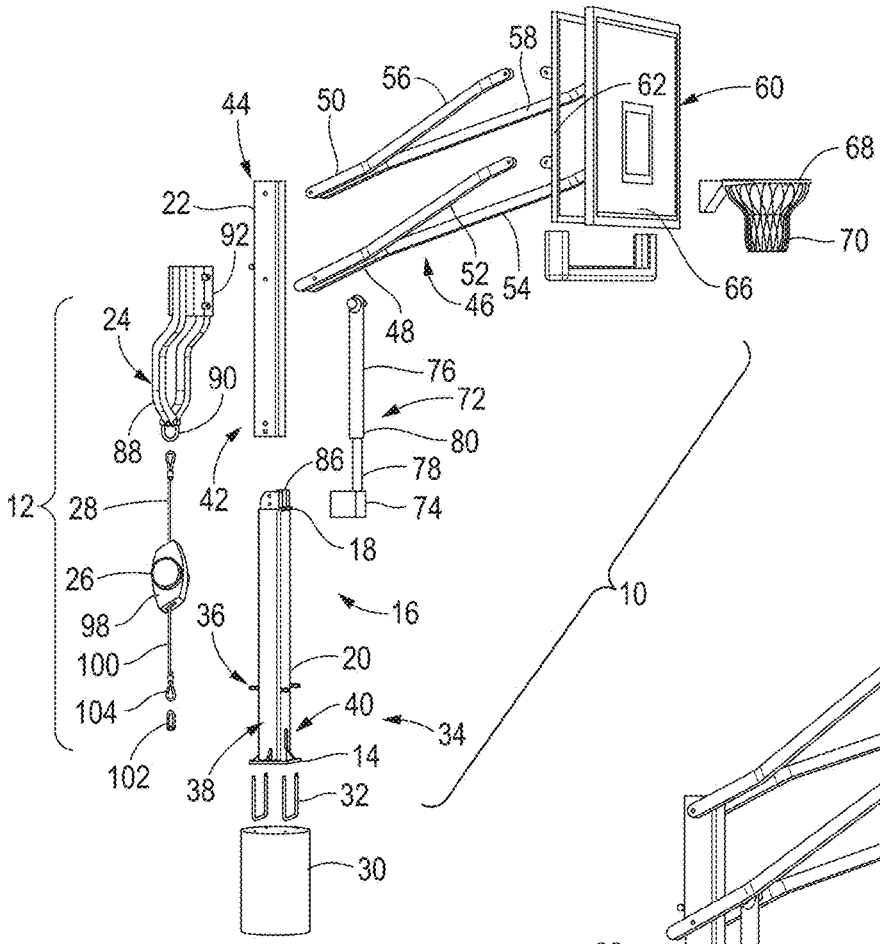
FIG. 1 is an exploded perspective view of a basketball system and a pole assembly system, according to an embodiment of the present invention.
Figure 2:
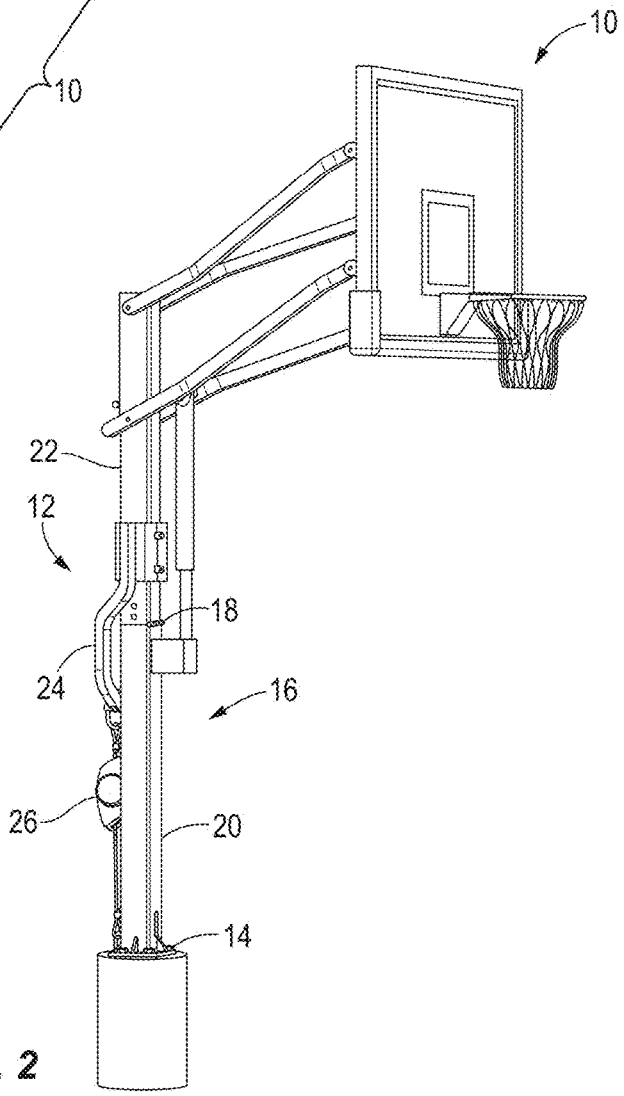
FIG. 2 is a perspective view of the basketball system, depicting the pole assembly system coupled thereto, according to another embodiment of the present invention.

Referring to FIGS. 1 and 2, a basketball system 10 and a pole assembly system 12 is provided. The basketball system 10 may be referenced herein as a basketball standard or basketball goal system. The basketball system 10 may include a base portion 14 and an upright portion 16 (or main pole). The upright portion 16 may include a hinge coupling 18 so as to define a lower pole 20 and an upper pole 22. The lower pole 20 and the upper pole 22 may be pivotably coupled to one another at the hinge coupling 18. In one embodiment, the lower pole 20 may include the base portion 14. The pole assembly system 12 may be configured to assist lifting the upper pole 22 from a pivoted position (FIG. 6) to an upright position (FIG. 2). The pole assembly system 12 may include a lever arm 24 and a lifting device 26. The lever arm 24 may be removably coupled to the upper pole 22. In some embodiments, the lifting device 26 may be removably coupled to the base portion 14, the lifting device including a line 28 extending from the lifting device 26 to the lever arm 24. Upon actuating the lifting device 26, the line 28 may be put into a taut state, the line 28 extending between the lifting device 26 and the lever arm 24. As such, the lifting device 26 may retract the line 28 to act and move one end of the lever arm 24 downward so that the upper pole 22 may pivot at the hinge coupling 18 and be lifted to the upright position.

Figure 11:
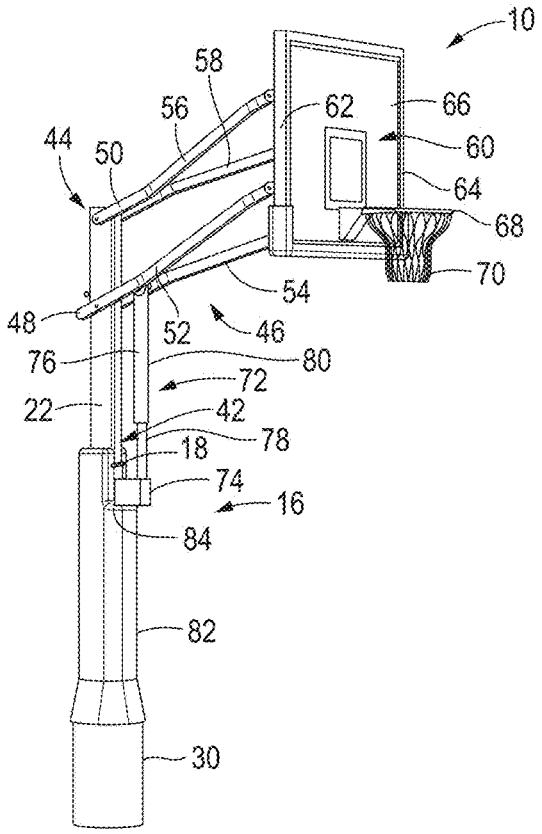
FIG. 11 is a perspective view of the basketball system in an upright and fully assembled position, depicting a pad positioned with the basketball system, according to another embodiment of the present invention.

Now, with reference to FIGS. 1 and 11, as previously set forth, the basketball system 10 may include the base portion 14 and the upright portion 16. The base portion 14 may be secured to a cement base 30 or the like with bolts 32. Further, the base portion 14 may be coupled to the upright portion 16 to provide stability to the upright portion 16. The upright portion 16 may extend to define a front side 34, a rear side 36, a left side 38, and a right side 40. The lower pole 20 and the upper pole 22 of the upright portion 16 may be hingeably coupled together at the hinge coupling 18. As such, the upper pole 22 may be moved from the pivoted position (FIG. 6) to the upright position (FIG. 2) or, if needed, the upper pole 22 may be moved from the upright position to the pivoted position. The upper pole 22 may be in the pivoted position relative to the lower pole 20 on a temporary basis and, upon the upper pole 22 being pivotably moved to extend vertically with the lower pole 20, the upper pole 22 may be fixated to the lower pole 20 in a non-pivotable manner so that the upper pole 22 may not pivot about the hinge 18. As such, the hinge coupling 18 between the lower and upper poles 20, 22 may temporarily facilitate pivoting the upper pole 22 relative to the lower pole 20 and, upon the upper pole 22 being moved to the upright position, then the upper pole 22 may be fixed in such upright position.

As set forth, the basketball system 10 includes the upper pole 22 pivotably coupled to the lower pole 20 at the hinge 18. The upper pole 22 may extend between a lower end 42 and an upper end 44. The lower pole 20 may also extend between opposing lower and upper ends such that the lower end of the lower pole 20 may be coupled to and/or extend vertically from the base portion 14. The upper end of the lower pole 20 may include inner flange portions 86 (see also FIG. 4) and the hinge coupling 18 each positioned adjacent to the upper end of the lower pole 20. Such flange portions 86 may be sized and configured to fit within the lower end 42 of the upper pole 22 so that the upper pole 22 may be fixated in the upright position. The fixating of the upper pole 22 to the lower pole 20 in the upright position may be employed with, for example, various types of fasteners, such as bolts, screws, nuts, and/or washers.

Adjacent to the upper end 44 or along an upper portion of the upper pole 22, link arms 46 may be coupled thereto. The link arms 46 may include one or more first arms 48 and one or more second arms 50. The first and second arms 48, 50 may extend somewhat perpendicular or transverse relative to the upper pole 22 and may be pivotably coupled thereto. Further, the first and second arms 48, 50 of the link arms 46 may be coupled to the left side 38 and right side 40 of the upper pole 22. In this manner, the first and second arms 48, 50 may both include at least two arms defining a left first arm 52, a right first arm 54, a left second arm 56, and a right second arm 58, respectively. Even further, the first and second arms 48, 50 may each extend from the upper pole 22 to a backboard 60 such that the backboard 60 may be positioned along the front side 34 of the upright portion 16. The left first arm 52 and the left second arm 56 may be coupled to the left side 38 of the upper pole 22 and a left edge 62 of the backboard 60. Similarly, the right first arm 54 and the right second arm 58 may be coupled to the right side 40 of the upper pole 22 and a right edge 64 of the backboard 60. In this configuration, the first arms 48 and second arms 50 may extend in a Y-shape from the upper pole 22 to the backboard 60. The backboard 60 may extend substantially parallel to the front side 34 of the upright portion 16. Further, the backboard 60 may extend with a flat surface 66 where a rim 68 may be coupled thereto. The rim 68 may extend substantially perpendicular to the backboard 60 and include a net 70 hanging therefrom.

The link arms 46 may be pivotably coupled to the upper pole 22 such that the first and second arms 48, 50 may pivot upwards or downwards. The basketball system 10 may also include a height actuator 72. The height actuator 72 may be coupled to the upright portion 16 and the first arms 48. In another embodiment, the height actuator 72 may be coupled to the upright portion 16 and the upper second arms 50. In one embodiment, the height actuator 72 may be coupled to the front side 34 of the upper pole 22 and the link arms 46, meaning the first and/or second arms 48, 50. In another embodiment, the height actuator 72 may be coupled to the front side 34 of the lower pole 20 and the link arms 46. In another embodiment, the height actuator 72 may be coupled to the rear side 36 of the upright portion 16 (lower or upper poles 20, 22) and to one or more of the link arms 46, discussed further herein. The height actuator 72 may include a base 74 and elongated portion 76. In one embodiment, the base 74 may be coupled to the front side 34 of the upper pole 22. The elongated portion 76 may be coupled to the first arms 48 of the link arms 46. More specifically, the elongated portion 76 may be coupled between the left first arm 52 and the right first arm 54. The height actuator 72 may be configured to facilitate the pivotable upward or downward movement of the first and second arms 48, 50. Such upward and downward movement may be employed with the elongated portion 76 of the height actuator 72 extending or contracting to move the first and second arms 48, 50. The elongated portion 76 may include an inner tube 78 and an outer tube 80. The inner tube 78 may be coupled to the base 74 of the height actuator 72, the base 74 being fixed to one of the lower and upper poles 20, 22. The outer tube 80 may be sized and configured to at least partially encase the inner tube 78 and extend or contract over the inner tube 78. Extension of the elongated portion 76 may correspond to the link arms 46 pivoting upwards and contraction of the elongated portion 76 may correspond to the link arms 46 pivoting downwards. Further, upon the link arms 46 moving upward, the backboard 60 and the rim 68 move upward. Such upward and downward movement may be implemented by the base 74 moving the elongated portion 76. The base 74 and the elongated portion 76 of the height actuator 72 may include various components for manually actuating the height actuator 72, such as a handle for actuating a lead screw within the elongated portion 76, or various components for automatically actuating the height actuator 72, such as a motor for actuating a lead screw to expand or contract the elongated portion 76 of the height actuator 72, as known by one of ordinary skill in the art. For example, the base 74 may be a hand crank or the like, to manually actuate the height actuator 72 or the base 74 may be motorized to automatically actuate the height actuator 72. Further, the elongated portion 76 may include various components, such as a lift assist shock and/or spring that may assist in the upward and downward movement of the link arms 46. As such, the user may actuate the height actuator 72 to employ upward and downward movement of the first and second arms 48, 50, which results in adjusting the height of the rim 68, as desired by the user. Furthermore, for safety purposes, upon the basketball standard 10 being fully assembled, a pre-formed pad 82 may be positioned or wrapped around the upright portion 12 encasing the lower pole 20 and partially encasing the upper pole 22. The pad 82 may include a slot 84 sized and configured for the base 74 of the height actuator 72 to be positioned therein. Further, the pad 82 may consist of a foam material or other such soft material.

Figure 1A:
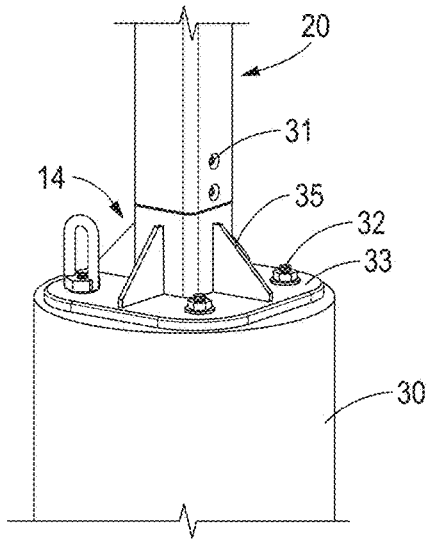
FIG. 1A is an enlarged perspective view of a portion of the basketball system, depicting a base portion of a lower pole secured to a cement pad, according to another embodiment of the present invention.

Further description of the assembly of the basketball system 10, will now be provided. With reference to FIGS. 1, 1A, 1B and 1C, some of the components of the basketball system 10 may be assembled. For example, bolts 32, such as u-bolts, may be set in the wet cement while forming the cement base 30 or cement pad. Upon the wet cement curing to form the cement base 30 with the bolts 32 positioned therein, the lower pole 20 may then be secured to the cement base 30, as depicted in FIG. 1A. In another embodiment, the cement base 30 may also be any other stabilizing structure, such as a steel base or a weighed down structure, such as a portable structure, sized and configured to stabilize the basketball system 10. The lower pole 20 may be secured by positioning and securing the base portion 14 to the bolts 32 fixated in the cement base 30. The lower pole 20 may then be secured to the base portion 14 with fasteners 31 sized and configured to secure one end portion of the lower pole 20 to the base portion 14. In one embodiment, the base portion 14 may be a separate component from the lower pole 20. In another embodiment, the base portion 14 may be integrally formed at one end of the lower pole 20. In either embodiment, the base portion 14 may include a horizontal flange 33 with support flanges 35 vertically positioned relative to the horizontal flange 33, the horizontal flange 33 having openings defined therein for receiving the bolts 32 and, thereby, coupling the base portion 14 and lower pole 20 to the cement pad 30.

Figure 1B:
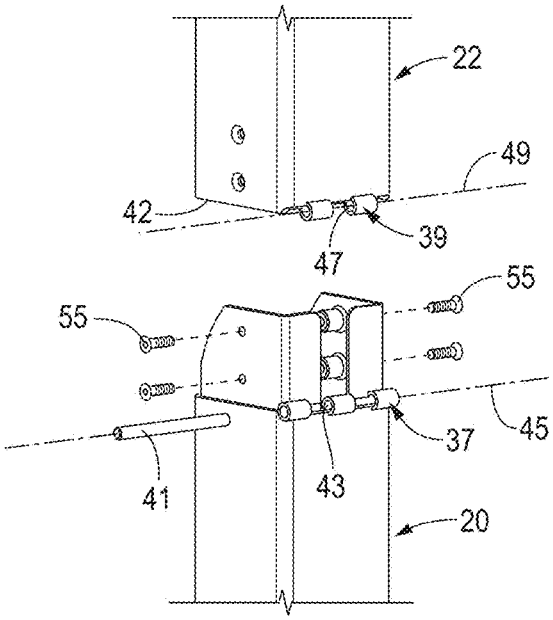
FIG. 1B is an exploded view of components for coupling an upper pole to a lower pole, according to another embodiment of the present invention.
Figure 1C:
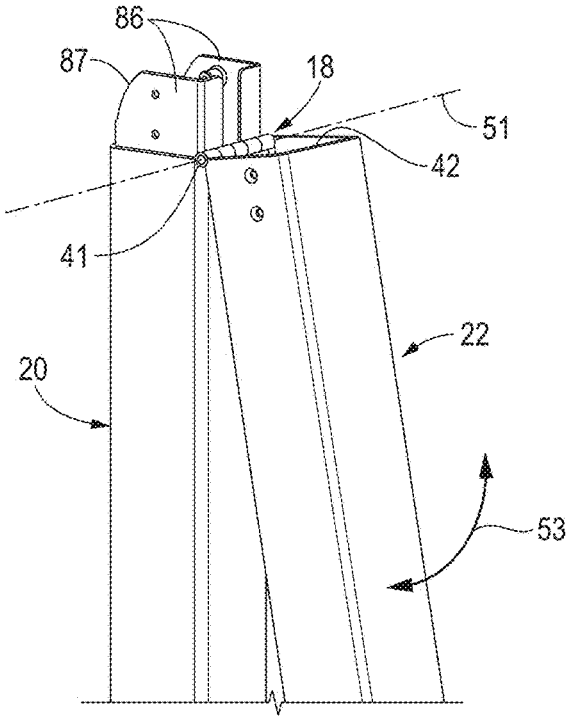
FIG. 1C is an enlarged perspective view of the upper pole pivotably coupled to the lower pole with a hinge coupling, depicting the upper pole in a pivoted position, according to another embodiment of the present invention.
Figure 1D:
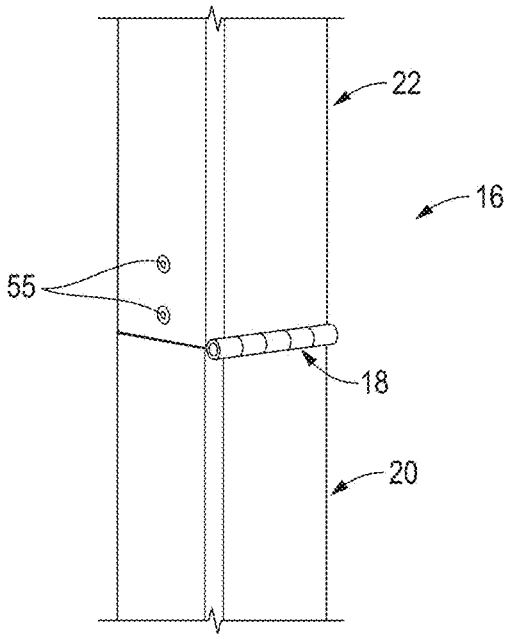
FIG. 1D is an enlarged perspective view of the upper pole coupled to the lower pole, depicting the upper pole fixated in an upright position, according to another embodiment of the present invention.

With reference to FIGS. 1, 1B and 1C, the upper pole 22 may be coupled to the lower pole 20 with a hinge coupling 18. Such hinge coupling 18 may include a lower pole hinge 37, an upper pole hinge 39, and a hinge pin 41. The lower pole hinge 37 may include a first hinge structure opening 43 defined therein so as to define a lower pole hinge axis 45, the lower pole hinge 37 positioned adjacent one end of the lower pole 20. The upper pole hinge 39 may define a second hinge structure opening 47 defined therein so as to define an upper pole hinge axis 49, the upper pole hinge 39 positioned adjacent the lower end 42 of the upper pole 22. The upper pole 22 may be pivotably coupled to the lower pole 20 by aligning the upper pole hinge axis 49 with the lower pole hinge axis 45, which also aligns the second hinge structure opening 47 with the first hinge structure opening 43 defined in the respective upper pole hinge 39 and the lower pole hinge 37. With this arrangement, upon aligning the upper pole hinge 39 with the lower pole hinge 37, the hinge pin 41 may be inserted through the first and second hinge structure openings 43, 47 to thereby couple the lower pole hinge 37 to the upper pole hinge 39 and form the hinge coupling 18, as depicted in FIG. 1C. Upon inserting the hinge pin 41 to form the hinge coupling 18, the upper pole 22 may be pivotably moved about a pivot axis 51 defined by the hinge pin 41 and the before described openings defined in the hinge coupling 18, as depicted by rotational arrow 53. In this manner, the upright portion 16 of the basketball system 10 may include a pivotable coupling or hinge coupling 18 for pivoting the upper pole 22 relative to the lower pole 20 to form the upright portion 16 of the basketball system 10. Upon the upper pole 22 being pivoted from the pivoted position to the upright position via the hinge coupling 18, pole fasteners 55 (see also FIG. 1B) may be employed to fixate the upper pole 22 to the lower pole 20 to form the upright portion 16 of the basketball system 10, as depicted in FIGS. 1, 1C and 1D. As will be set forth herein in further detail, such hinge coupling 18 defined in the upright portion 16 or main pole of the basketball system 10 may be advantageous for assisting in the assembly of the various components of the basketball system 10.

Figure 6:
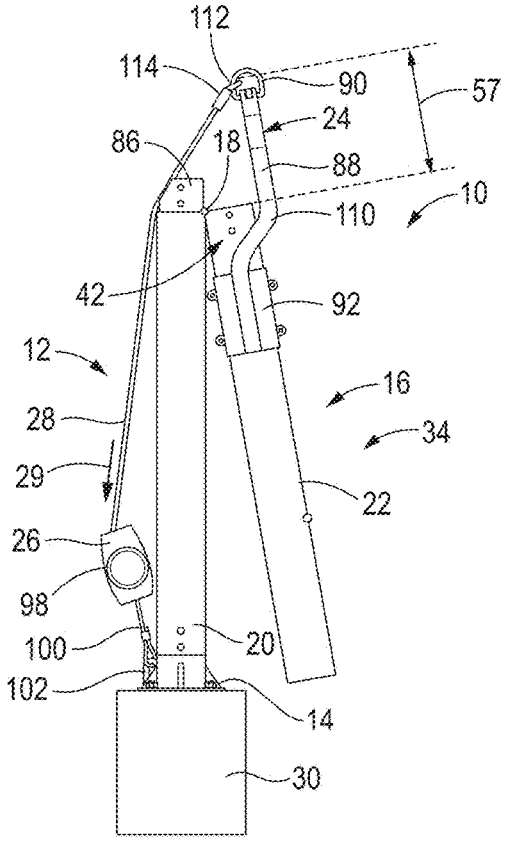
FIG. 6 is a side view of the lower and upper poles of the basketball system and the pole assembly system positioned therewith, depicting the upper pole of the upright portion in a pivoted position, according to another embodiment of the present invention.

With reference to FIGS. 1 and 6, upon the upper pole 22 being pivotably coupled to the lower pole 20, described and depicted in FIG. 1A-1C, then the lower and upper poles 20, 22 may be coupled to the pole assembly system 12. Such pole assembly system 12 may be coupled to the lower and upper poles 20, 22, upon the upper pole 22 being in the pivoted position, as depicted in FIG. 6. As previously set forth, the pole assembly system 12 may include the lever arm 24, the lifting device 26 and the line 28. In this pivoted position, the upper pole 22 may be pivotably coupled to the lower pole 20 with the hinge coupling 18. The base portion 14 may be secured to the cement base 30 so that the lower pole 20 may be secured thereto and/or so that the lower pole 20 may extend vertically from the base portion 14.

Referring now to FIGS. 1, 1C and 1D, with the upper pole 22 in the pivoted position, an upper end portion of the lower pole 20 may be exposed to exhibit inner flange portions 86 that may be integrally formed with and extend from the lower pole 20. The inner flange portions 86 may be sized and configured to fit within the upper pole 22, upon the upper pole 22 being pivoted to the upright position or a closed, non-pivoted position. Further, the inner flange portions 86 may extend with a taper or curved portion 87, such that during assembly of the upright portion 16, the upper pole 22 may easily pivot over the inner flange portions 86 of the lower pole 20. Even further, the inner flange portions 86 may facilitate fixating the upper pole 22 to the lower pole 20 in the upright position (see FIG. 1D). Such inner flange portions 86 of the lower pole 20 may be configured to provide reinforcement to the fixated coupling between the lower pole 20 and upper pole 22. The inner flange portions 86 may secure the upper pole 22 to the lower pole 20 with the use of the pole fasteners 55 extending through the upper pole 22 and the inner flange portions 86 of the lower pole 20 (see FIGS. 1B and 1D). In another embodiment, the inner flange portions 86 may be integrally formed and extend from the lower end 42 of the upper pole 22.

Figure 3:
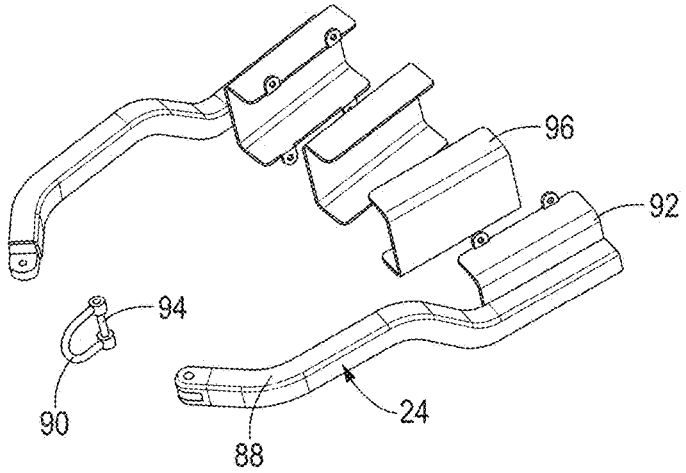
FIG. 3 is an exploded view of a lever arm of the pole assembly system, according to another embodiment of the present invention.
Figure 4:
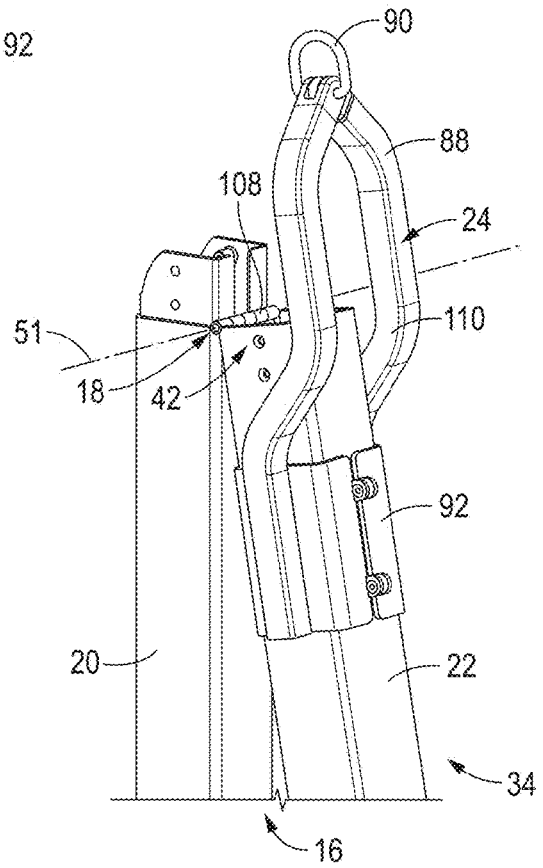
FIG. 4 is a perspective view of a hinge coupling of the basketball system, depicting the lever arm positioned on the upper pole, according to another embodiment of the present invention.

With reference to FIGS. 1, 3, and 4, as previously set forth, the pole assembly system 12 may include the lever arm 24 and the lifting device 26. The lever arm 24 may be configured to be removably coupled to the upper pole 22 of the upright portion 16. The lever arm 34 may be an elongated structure and extend with at least one bend along a length of the elongated structure of the lever arm 24. Further, the lever arm 24 may extend in a u-shape to define support arms 88 extending from a lever ring 90. The support arms 88 of the lever arm 24 may extend toward brackets 92 coupled at one end portion of the support arms. The lever ring 90 may extend in a D-shape and include a pin 94 configured to extend through the support arms 88 of the lever arm 24, coupling the support arms 88 to the lever ring 90. The support arms 88 may pivot around the pin 94, such that, the support arms 88 may be moved between open and closed positions. The brackets 92 may face one another extending with a generally u-shape. In the closed position, the brackets 92 of the support arms 88 may pivot or move closer to each other. In the open position, the brackets 92 of the support arms 88 may pivot and move the brackets 92 further away from each other. In this manner, the support arms 88 may be configured to position the brackets 92 to hold or grip onto the upper pole 22 of the upright portion 16 with the lever ring 90 positioned well beyond the lower end 42 of the upper pole 22. As such, the brackets 92 of the lever arm 24 may be temporarily coupled to the upper pole 22 by coupling the brackets 92 with, for example, fasteners or any other suitable coupling structure. Further, the brackets 92 may include bracket sleeves 96 that may extend along an inner side of the brackets 92 so as to provide padding to the upper pole 22 when the lever arm 24 may be coupled thereto. The bracket sleeves 96 may be a rubber material or other non-abrasive material. With this arrangement, the lever arm 24 may be coupled to the upper pole 22 via the brackets 92 such that the support arms 88 of the lever arm 24 extend from the brackets 92 so as to extend beyond the upper pole 22 and beyond and/or over the hinged coupling 18 (beyond or over the pivot axis 51 of the hinge coupling 18), discussed further herein.

Figure 5:
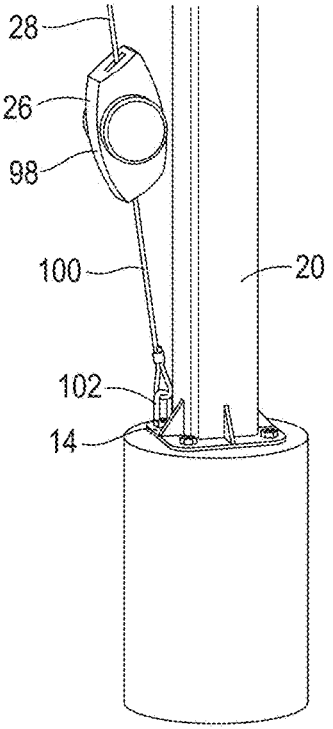
FIG. 5 is a perspective view of the base portion and the lower pole of the basketball system, depicting a lifting device coupled thereto, according to another embodiment of the present invention.

With reference to FIGS. 1 and 5, the lifting device 26 of the pole assembly system 12 may be coupled to the base portion 14 of the basketball system 10. Further, the lifting device 26 may include a housing 98, the line 28, and a lower line 100. The line 28 may extend upwards, somewhat parallel to the upright portion 16, towards the lever ring 90 of the lever arm 24. The lower line 100 may extend downwards toward the base portion 14, where the lower line 100 may couple to the base portion 14 or to structure positioned in the cement base 30. The housing 98 may be sized and configured for the line 28 of the lifting device 26 to be retracted and extended therefrom. As such, the housing 98 of the lifting device may include a motor (not shown) associated therewith so that a user may activate the motor and lifting device to either retract or extend the line 28 to, thereby, pivot the lever arm 24 and, thus, pivot the upper pole 22. The lifting device 26 may include the motor and components associated with the motor to facilitate motorized and automatic movement of the line 28, as known to one of ordinary skill in the art. In another embodiment, the lifting device 26, being coupled to the base portion 14 of the basketball standard 10, may also be a manual type lifting device 26, such as a lifting device having a hand crank or the like. In either embodiment of a motorized or manual lifting device, the lifting device 26 may be configured for a user to manually retract and extend the line 28 into and out of the housing 98 of the lifting device 26 to pivot the upper pole 22.

In another embodiment, the lifting device 26 (or any lifting device set forth herein) may be referenced as a pulling device. In still another embodiment, the lifting device 26 set forth herein may be any known lifting device or pulling device or the like, such as a winch or a hoist device, that may be motorized or manually driven, or any other suitable lifting device for pulling a load, as known to one of ordinary skill in the art. In still another embodiment, the lifting device may be an electrically motorized pulling device or lifting device, as known to one of ordinary skill in the art. In still another embodiment, the line 28 and the line 100 may be a rope, a cable, a chain or a strap, such as a webbed strap or the like, or any suitable line type structure and material that can be placed in tension and be wound over a spool or drawn within the housing 98 of the lifting device 26, for example.

Figure 5A:
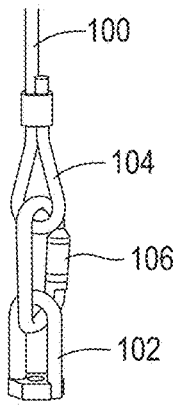
FIG. 5A is a perspective view of a coupling between a line of the lifting device and a base ring, according to another embodiment of the present invention.

Now with reference to FIGS. 1, 5, and 5A, the base portion 14 of the basketball standard 10 may include a base ring 102. The base ring 102 may be associated with the base portion 14 in several different ways, namely, the base ring 102 may be integral to the base portion 14, or the base ring 102 may be associated with one of the bolts 32 securing the base portion 14 to the cement base 30, or the base ring 102 may be cured within the cement of the cement base 30 adjacent the base portion 14. With this arrangement, the base ring 102 may be sized and configured to couple the lower line 100 of the lifting device 26 to the base portion 14. The lower line 100 of the lifting device 26 may include a lower loop 104. In one embodiment, the lower loop 104 may directly couple to the base ring 102, where the base ring 102 includes a latch or way to decouple the loop 104 from the base ring 102 or the base ring 102 may be removably coupled to the base portion 14. In another embodiment, the lower loop 104 may couple to the base ring 102 with a lower clip 106, such as a carabiner type clip, or any other suitable coupling piece, such as a hook or clasp or the like. In this manner, the lower clip 106 may decouple the lower line 100 of the lifting device 26 from the base ring 102 such that the lifting device 26 may be readily removed from the basketball standard 10 once use of the lifting device 26 is completed.

With reference to FIGS. 4, 5, and 6, as previously set forth, the upper pole 22 may be pivotably coupled with the hinge coupling 18 to the lower pole 20 with the lever arm 24 coupled to the upper pole 22 while the upper pole 22 is in the pivoted position. The support arms 88 of the lever arm 24 may include portions that may extend parallel to the upper pole 22. The support arms 88 may include bends 110 defined therein (or one or more bends 110 or at least one bend) such that the lever arm 24 may not extend in line with the upper pole 22 such that the support arms 88 may extend along one side of the upper pole 22. In this manner, the support arms 88 of the lever arm 24 do not interfere with the assembly of the upright portion 16. Further, the support arms 88 may be configured to withstand tension and weight put onto the lever arm 24 during assembly of the basketball system 10. For increased leverage for pivoting the upper pole 22, the support arms 88 and a portion of the lever ring 90 may extend a distance 57 beyond the lower end 42 of the upper pole 22. As such, the position of the brackets 92 coupling the lever arm 24 to the upper pole 22 may be such so as to provide the distance 57 that the lever arm 24 extends beyond the upper pole 22 to provide the desired leverage to more readily pivot the upper pole 20 about the hinge coupling 18. Further, the bends 110 or at least one bend in the lever arm 24 may extend so that the support arms 88 of the lever arm 24 may not interfere with the lower pole 20 during the assembly of the upright portion 16.

The line 28 of the lifting device 26 may extend from the housing 98 of the lifting device 26 to the lever ring 90 of the lever arm 24. The line 28 may include an upper loop 112, where the upper loop 112 may couple to the lever ring 90. The upper loop 112 may be coupled to the lever ring 90 such that the lever ring 90 may be removable from the lever arm 24. In another embodiment, the upper loop 112 may include an upper clip 114 sized and configured to clip to the lever ring 90. The upper clip 114 may be a carabiner type coupling, or a hook or clasp or any other suitable type coupling. In this configuration, the lifting device 26 and the lever arm 24 may be removably coupled relative to the basketball system 10. Further, in this configuration, the lifting device 26 and the lever arm 24 may be removably coupled relative to each other. As depicted in FIG. 6, upon the lever arm 24 being coupled to the upper pole 22 with the lifting device 26 extending between the lever arm 24 with the line 28 and the base portion 14 and the lower line 100, the pole assembly system 12 may be employed to move and pivot the upper pole 22 relative to the lower pole 20.

Figure 7:
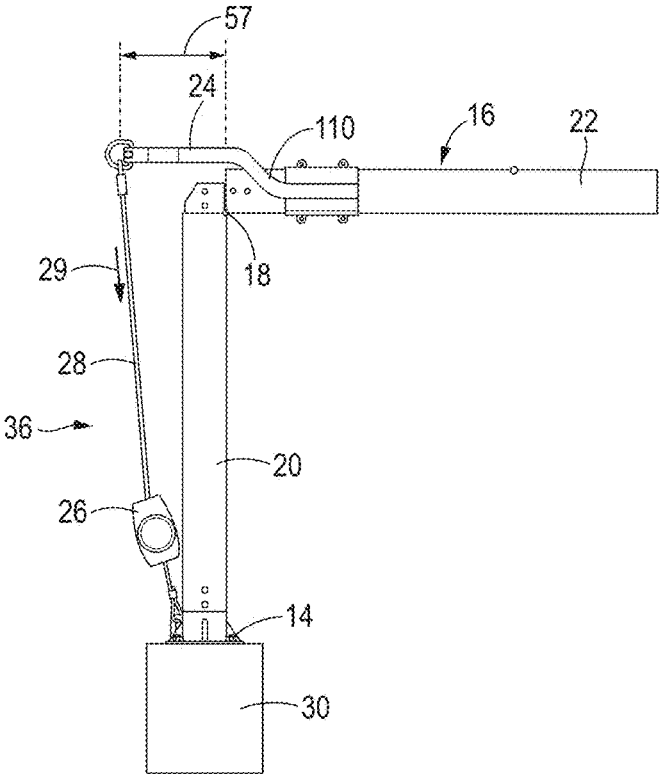
FIG. 7 is a side view of the lower and upper poles of the basketball system, depicting the pole assembly system pivoting the upper pole to a first intermediate position, according to another embodiment of the present invention.
Figure 8:
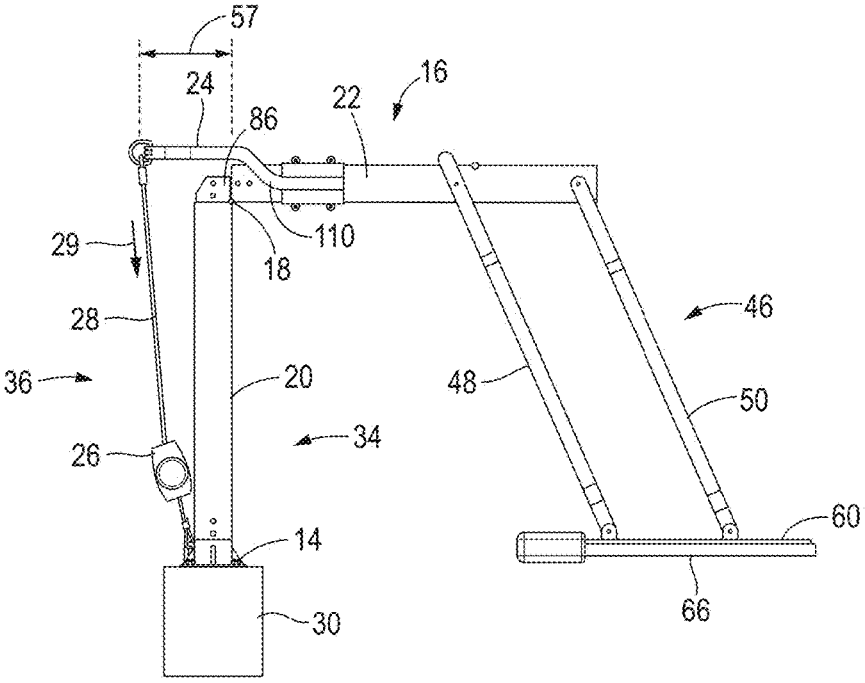
FIG. 8 is a side view of the basketball system, depicting the upper pole in the first intermediate position with link arms and a backboard coupled to the upper pole, according to another embodiment of the present invention.

Now with reference to FIGS. 6, 7 and 8, the lifting device may be activated by the user, causing the line 28 to become taut such that the lifting device 26 may be further activated to retract the line 28, as depicted by arrow 29, so that the upper pole 22 may be pivotably moved via the hinge coupling 18 to a first intermediate position (FIG. 7). As previously set forth, the lever arm 24 may extend beyond and/or over the hinge coupling 18 the distance 57 to assist in providing the leverage necessary for pivoting the upper pole 22 about the hinge coupling 18 and about the axis 51 defined between the upper pole 22 and the lower pole 20. Further, the lever arm 24 having at least one bend 110 along a length of the lever arm 24 may assist the assembly of the lower and upper poles 20, 22 so that the lever arm 24 does not interfere with the lower pole 20. In the first intermediate position, the line 28 may be retracted by the lifting device 26 so that the lever arm 24 may lift and pivot the upper pole 22 to be oriented horizontally or to about a horizontal position, or another raised position to facilitate readily assembling of various components of the basketball system 10. As such, in the first intermediate position, the upper pole 22 may be substantially perpendicular relative to the lower pole 20. Further, the lever arm 24 may extend generally perpendicular relative to the lower pole 20. Once the upper pole 22 is in the generally horizontal position, then the backboard 60 may be positioned on the ground below the upper pole 22. The user may then position the link arms 46 adjacent the backboard 60 and the upper pole 22. As depicted in FIG. 8, such positioned link arms 46 may then be coupled to the basketball system 10 such that the first arms 48 and the second arms 50 of the link arms 46 may be coupled between the upper pole 22 and to one side of the backboard 60 with the appropriately provided fasteners. Such coupling of the link arms 46 may be pivotable couplings so that the height of the basketball system 10 may be adjusted, as previously described.

Figure 9:
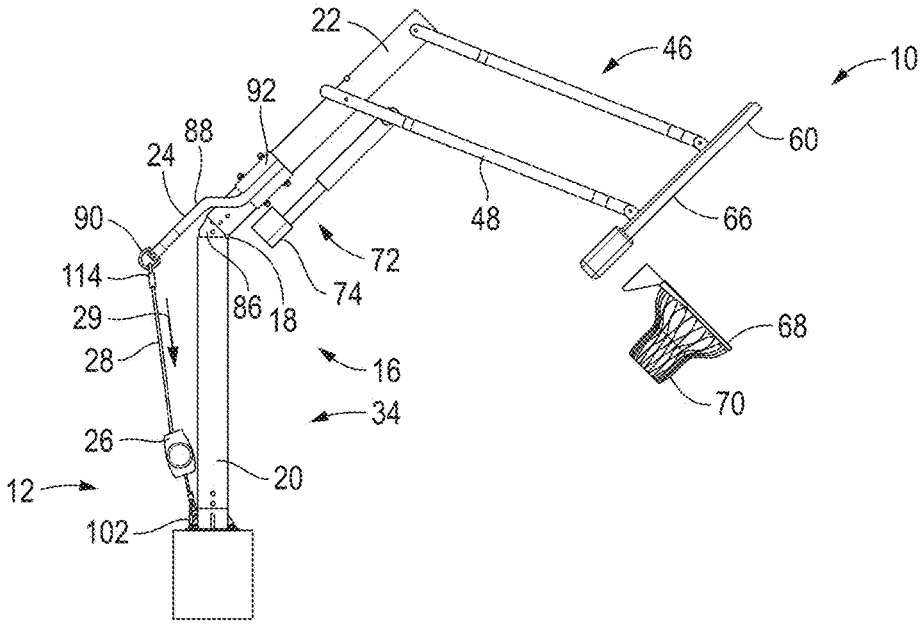
FIG. 9 is a partially exploded side view of the basketball system, depicting the pole assembly pivoting the upper pole to a second intermediate position for receiving a rim of the basketball system and coupling a height actuator to the link arms of the basketball system, according to another embodiment of the present invention.

With reference to FIGS. 8 and 9, the lifting device 26 of the pole assembly system 12 may be activated to pull the line 28, as shown by arrow 29, and pivotably move the upper pole 22 from the first intermediate position to a second intermediate position via the hinge coupling 18. In the first or the second intermediate position, the height actuator 72 may be coupled to the first link arms 48. Further, in the second intermediate position, the lever arm 24 may be pulled by the lifting device 26 to extend at a downward extending angle relative to the horizontal. As such, the upper pole 22 may be pivoted to extend at a similar downward extending angle so as to extend generally parallel to the lever arm 24. In the second intermediate position, the upper pole 22 may begin to extend over to encase the inner flange portions 86 of the lower pole 20. Further, the line 28 of the lifting device 26 may maintain its tension to hold or maintain the upper pole 22 in the second intermediate position. In the second intermediate position, the rim 68 may be coupled to the flat surface 66 of the backboard 60, the rim 68 including the net 70 hanging therefrom. Prior to coupling the height actuator 72 to the upper pole 22 or the lower pole 20, the height actuator 72 may be fully extended. As previously set forth, the height actuator 72 may be coupled to the first arms 48 (or the second arms 50) of the link arms 46 and along the front side 34 of the upper pole 22. Further, the base 74 of the height actuator 72 may be positioned and coupled to the upper pole 22 or, in another embodiment, the base 74 of the height actuator 72 may be coupled to the lower pole 20.

Figure 10:
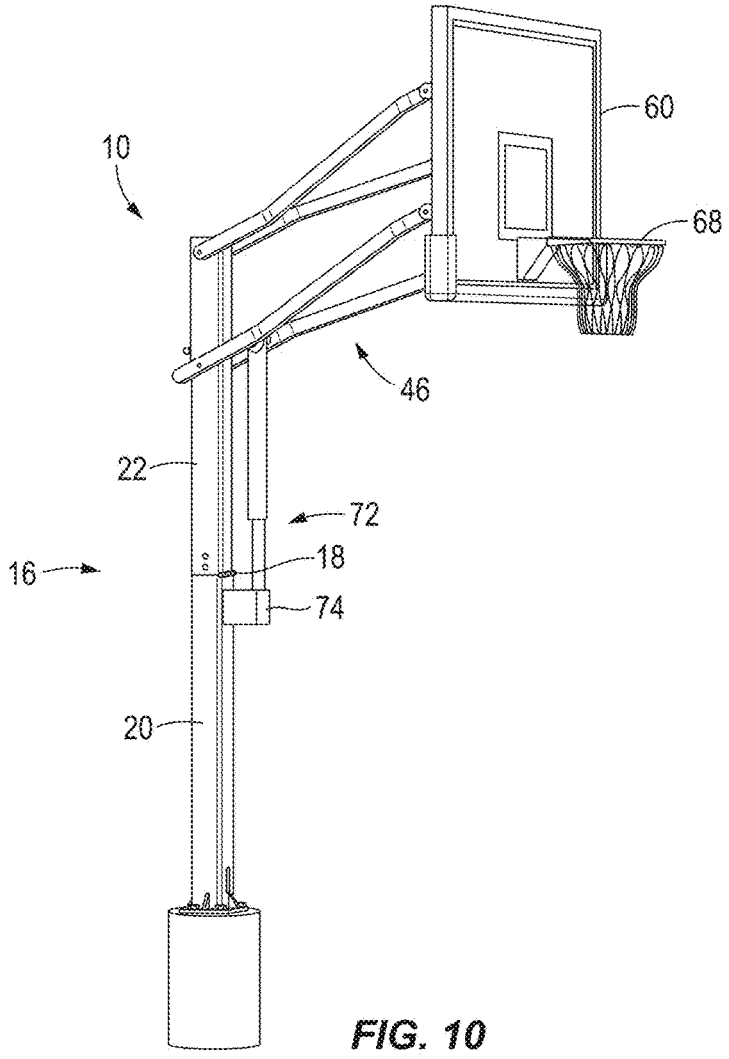
FIG. 10 is a perspective view of the basketball system in an upright position, depicting the height actuator coupled to the upright portion of the basketball system and with the upper pole fixated in the upright position, according to another embodiment of the present invention.

With reference to FIGS. 9, 10, and 11, upon the link arms 46, backboard 60, height actuator 72, and rim 68 being coupled to the upright portion 16 or main pole, the lifting device 26 may again retract the line 28 so that the upper pole 22 and the upright portion 16 may be pivotably moved about the hinge coupling 18 to an upright position or final position. In this upright, vertically extending position, the lower end 42 of the upper pole 22 may enclose the inner flange portions 86 of the lower pole 20, as previously described. At this stage, the upper pole 22 may be fixedly coupled to the lower pole 20 in the upright vertical position using the pole fasteners 55 (see FIGS. 1B and 1D) that may extend through each of the upper pole 22 and the inner flange portions 86 of the lower pole 20. Once the upper pole 22 is fixedly coupled to the lower pole 20 in the upright position, the upper clip 114 of the line 28 may be uncoupled from the lever ring 90 of the lever arm 24 and, the lower clip 106 (FIG. 5A) may be uncoupled from the base ring 102. In this manner, the lifting device 26 may be removed from the basketball system 10. Further, the lever arm 24 may be removed from the upper pole 22 by removing the nuts and screws coupling the brackets 92 to one another and opening the support arms 88 of the lever arm 24. With the pole assembly system 12 removed from the basketball system 10, the pad 82 may be positioned over and around a portion of the upright portion 16 with the base 74 of the height actuator 72 positioned in a slot 84 of the pad 82. With this arrangement, the pole assembly system 12 may be employed to assemble the basketball goal system 10 with a single person, despite the height and weight of the basketball system 10. It is the structural arrangement of the upright portion 16 or main pole of the basketball system 10 with the upper pole 22 being pivotably coupled to the lower pole 20 that facilitates the ability of a single person to assemble the basketball system 10, set forth herein. To facilitate the advantages of the pivotable coupling between the lower and upper poles 20, 22, the hinge coupling 18 of the basketball system 10 may be about 5 feet above the cement pad 30 or the base portion 14 of the basketball system 10 such that the hinge coupling 18 may be located at about half of the intended height of the rim 68 and such that about 5 feet above may mean within the range of between about 4.5 feet and about 5.5 feet above the cement pad 30 or the base portion 14. In another embodiment, the hinge coupling 18 of the basketball system 10 may be within the range of between about four feet and about six feet above the cement pad 30 or base portion 14 of the basketball system 10. In another embodiment, the hinge coupling 18 of the basketball system 10 may be within the range of between about two feet and about eight feet above the cement pad 30 or the base portion 14 of the basketball system 10. In another embodiment, the hinge coupling 18 of the basketball system 10 may be within the range of between about one foot and about eight feet above the cement pad 30 or the base portion 14 of the basketball system 10.

Figure 12:
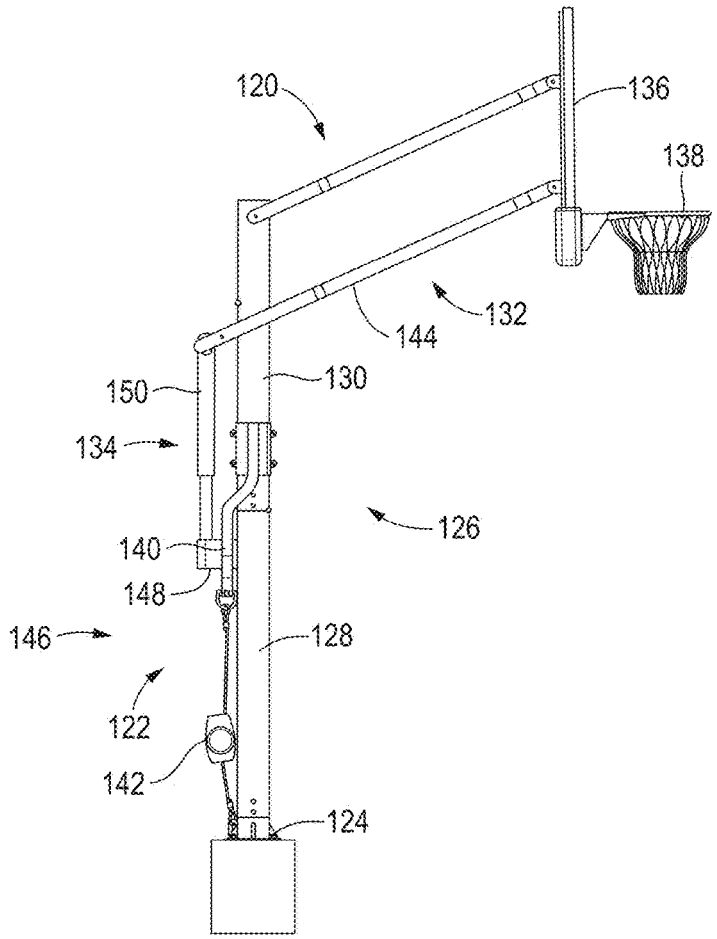
FIG. 12 is a side view of another embodiment of a basketball system, depicting a height actuator coupled to a rear side of an upright portion of the basketball system, according to the present invention.

Now with reference to FIG. 12, another embodiment of a basketball system 120 and pole assembly system 122 is provided. This embodiment of the basketball system and pole assembly system 122 may be similar to the previous embodiment by including similar components and, as such, the assembly of the basketball system may be substantially similar to the previously described embodiment. The basketball system 120 may include a base portion 124 and an upright portion 126 or main pole. The upright portion 126 may include a lower pole 128 pivotably coupled to an upper pole 130. The upright portion 126 or main pole may be coupled to link arms 132, a height actuator 134, a backboard 136, and a rim 138. The pole assembly system 122 may include a lever arm 140 and a lifting device 142. As indicated, the basketball system 120 and pole assembly system 122 may function similarly to the previous embodiment described above, except the height actuator 134 may be coupled to a first arm 144 of the link arms 132 along a rear side 146 of the upright portion 126. The height actuator 134 may include a base 148 and an elongated portion 150, where, the base 148 may be coupled to either the lower pole 128 or the upper pole 130 of the rear side 146 of the upright portion 126 and the elongated portion 150 may be coupled to the first arms 144 (or the second arms 145) of the link arms 132. The link arms 132 may be coupled similarly to the upper pole 130 of the upright portion 126, as described in the previous embodiment. However, the first arm 144 may extend longer so as to extend beyond the rear side 146 of the upper pole 130 so that the elongated portion 150 of the height actuator 134 may be coupled to the portion extending beyond the rear side 146 of the upper pole 130. As such, the height actuator may be configured to retract and extend so the link arms 132 may pivot on the upper pole 130 and move the backboard 136 and rim 138 upwards or downwards to a desired height.

Figure 13:
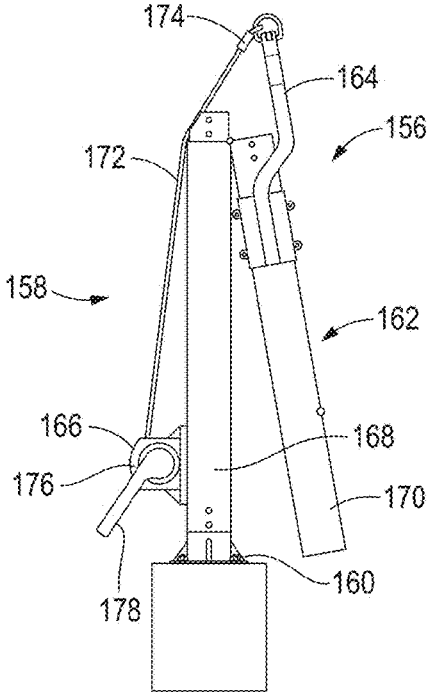
FIG. 13 is a side view of another embodiment of an upper pole pivotably coupled to a lower pole of a basketball system, depicting a manually actuated lifting device coupled to the lower pole, according to another embodiment of the present invention.

With reference to FIG. 13, another embodiment of a basketball system 156 and pole assembly system 158 is provided. This embodiment may be similar functionally and structurally to previous embodiments set forth herein by including similar components for the basketball system 156 and the pole assembly system 158. The basketball system 156 may include a base portion 160 and an upright portion 162 (or main pole). The pole assembly system 158 may include a lever arm 164 and a lifting device 166. The upright portion 162 may include a lower pole 168 and an upper pole 170, the upper pole 170 being pivotably coupled to the lower pole 168 with a hinge coupling, similar to previous embodiments. As previously set forth, the lower pole 168 may be a separate piece from the base portion 160 or, in another embodiment, the lower pole 168 may be integrally formed (with welded components) with the base portion 160 as a one-piece structure. The lifting device 166 of the pole assembly system 158 of this embodiment may be coupled directly to the lower pole 168. Such lifting device 166 may be removably coupled to the lower pole 168 of the upright portion 162 via fastening with bolts, screws, nuts, and washers. The lifting device 166 may be coupled to the lever arm 164 by a line 172 and an upper clip 174. The line 172 may be placed in tension by activating the lifting device 166 such that the line 172 and the lever arm 164 may lift and pivot the upper pole 170 to various intermediate positions to couple the components of the basketball system and then to pivot the upper pole 170 to an upright position, as similarly described in previous embodiments. In this embodiment, the lifting device 166 may be fixated to the lower pole 168 and may be a manual hand crank type lifting device. In another embodiment, instead of the hand crank type lifting device, the lifting device may be a motorized type lifting device, similar to the lifting device set forth relative to FIGS. 6-9, except the motorized lifting device would be coupled to the lower pole 168, similar to that depicted in FIG. 13. It should also be noted that the lifting device set forth in FIGS. 6-9 may also be a manually generated hand type crank lifting device, similar to the lifting device set forth and depicted in FIG. 13. In this manner, the lifting device 166 of this embodiment, may be coupled to the lower pole 168 and may be employed, whether the lifting device is motorized or manually generated, for the purpose of pivoting the lower pole 168 to various stages for assembling the basketball system 156, similar to that depicted in previous embodiments.

Figure 14:
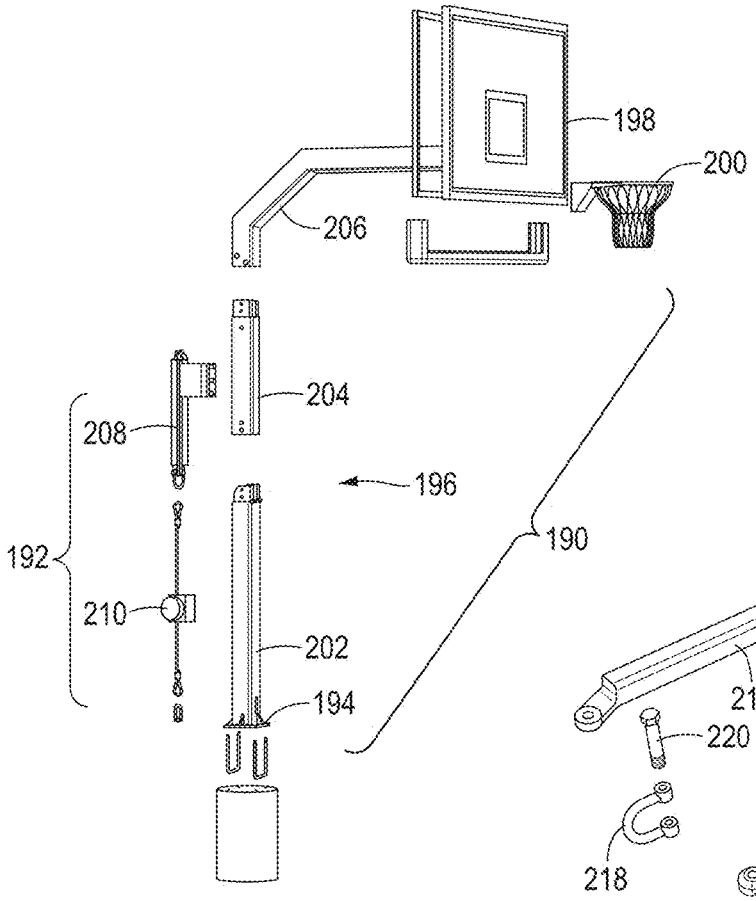
FIG. 14 is an exploded perspective view of another embodiment of a basketball system and a pole assembly system, according to another embodiment of the present invention.
Figure 16:
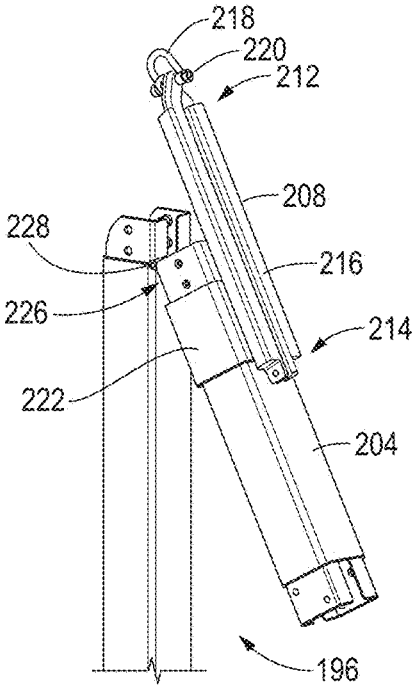
FIG. 16 is a perspective view of an upper pole pivotably coupled to a lower pole with a hinge coupling of the basketball system, depicting the lever arm positioned on the upper pole, according to another embodiment of the present invention.

Now with reference to FIGS. 14 and 16, another embodiment of a basketball system 190 and pole assembly system 192 is provided. The basketball system 190 of this embodiment may be a non-adjustable type basketball system, meaning the height of the basketball system 190, once fully assembled, may not be readily adjusted since this basketball system may not include the before described height actuator. The basketball system 190 may be configured to function similarly and include similar components to the previous embodiments. For example, the basketball system may include a base portion 194, an upright portion 196, a backboard 198, and a rim 200. The upright portion 196 or the main pole of the basketball system 190 may include a lower pole 202 and an upper pole 204, the upper pole 204 pivotably coupled to the lower pole 202. Further, the lower pole 202 may include the base portion 194 such that the lower pole 202 may extend vertically from the base portion 194. Similar to previous embodiments, the upper pole 204 may be pivotably coupled to the lower pole 202 with a hinge coupling 228. Further, in this embodiment, the upright portion 196 of the basketball system 190 may include an upper extension 206 or second upper pole. The upper pole 204 may be a straight pole member. The upper extension 206 may include one or more bends and/or a curved portion, sized and configured to couple to one end of the upper pole 204. Further, the upper extension 206 may be coupled to the backboard 198 and rim 200. Even further, the upper extension 206 may be sized and configured to be fixed to the upper pole 204 such that there is no height actuator in this embodiment so the height of the backboard 198 may not be readily adjusted. The pole assembly system 192 may also include similar components as the previous embodiments, such as, a lever arm 208 and a lifting device 210.

Figure 15:
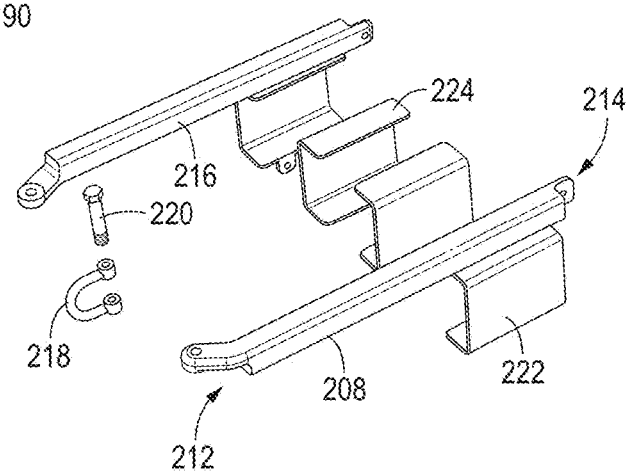
FIG. 15 is an exploded view of another embodiment of a lever arm, according to the present invention.

Now with reference to FIGS. 15 and 16, the lever arm 208 may extend from a first end 212 to a second end 214 to define support arms 216. The first end 212 of the support arms 216 may include a lever ring 218 coupled thereto. The lever ring 218 may extend in a D-shape and include a pin 220. The pin 220 may extend through the support arms 216 and couple to the lever ring 218 such that the lever ring 218 and pin 220 arrangement may couple the support arms 216 to each other. In this configuration, the support arms 216 may be moveable to open and closed positions around the pin 220 of the lever ring 218. The support arms 216 may extend between the first end 212 and the second end 214 such that brackets 222 may be coupled adjacent to the second end 214. The brackets 222 may be sized and configured to clamp around and be coupled to a portion of the upper pole 204 such that the support arms 216 and lever ring 218 extend beyond a lower end 226 of the upper pole 204 a distance so as to provide a lever advantage for pivoting the upper pole 204 about the hinge coupling 228 and relative to the lower pole 202, similar to that described in previous embodiments. The brackets 222 may also include bracket sleeves 224 configured to protect the upper pole 204 during the assembly process.

The lever arm 208 may be removably coupled adjacent to the lower end 226 of the upper pole 204. Upon the lever arm 208 being coupled to the upper pole 204, the support arms 216 may extend generally parallel with the length of the upper pole 204 and past a hinge coupling 228 of the upright portion 196 in a straight manner. Further, the lever arm 208 may be sized and configured to extend so that the lever arm 208 may not interfere with the pivoting and assembly of the upright portion 196. The brackets 222 may grip or hold the upper pole 204 by securing the brackets 222 to one another with bolts, screws, nuts, and washers, for example.

Figure 17:
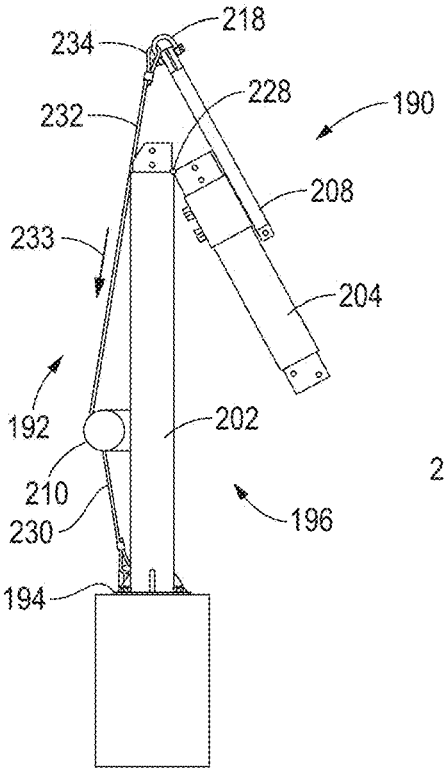
FIG. 17 is a side view of the upper pole pivotably coupled to the lower pole of the basketball system, depicting a lifting device and lever arm of a pole assembly system coupled to the upper pole in the pivoted position, according to another embodiment of the present invention.

Now with reference to FIGS. 17-22, the assembly of the basketball system 190 with the pole assembly system 192 will now be described. With reference first to FIG. 17, the pole assembly system 192 may be removably coupled to the basketball system 190, similar to previous embodiments. For example, the lifting device 210 may be coupled to the base portion 194 with a lower line 230 and the lever arm 208 may be coupled to the upper pole 204, as described above. Further, the lifting device 210 may include a line 232 that may extend from the lifting device 210 to be coupled to the lever ring 218 with an upper clip 234. Once the pole assembly system 192 is coupled to the upper pole 204 and the base portion 194, as set forth above, the lifting device 210 may be activated to put the line 232 in a taut state, as shown by arrow 233, so that the line 232 may pivot the upper pole 204.

Figure 18:
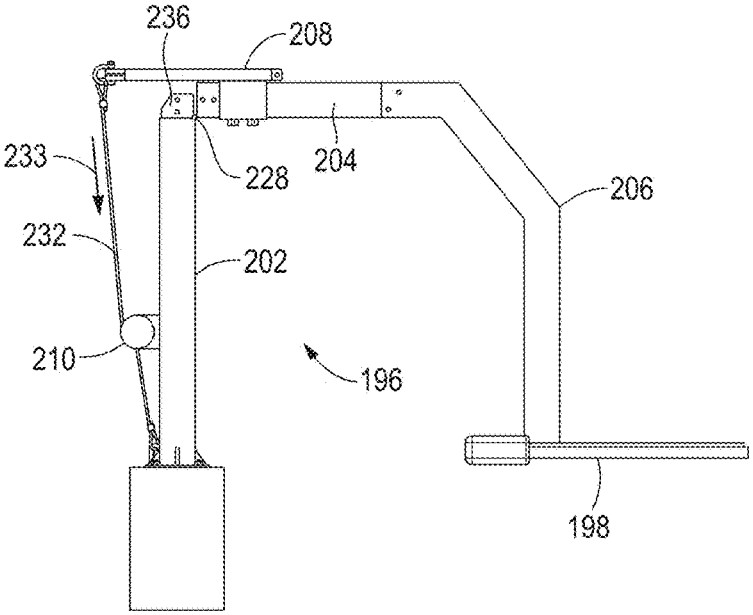
FIG. 18 is a side view of the upper pole pivotably coupled to the lower pole of the basketball system, depicting the pole assembly system lifting the upper pole to a first intermediate position for coupling additional components of the basketball system to the upper pole, according to another embodiment of the present invention.

With reference to FIGS. 17 and 18, the lifting device 210 may be configured to retract the line 232 to pivot the lever arm 208 and, thus, the upper pole 204 about the hinge coupling 228 so that the upper pole 204 may be moved to a generally horizontal position or a first intermediate position (FIG. 18). In the first intermediate position of the upper pole 204, the line 232 may retract into the lifting device 210, such that, the line 232 may provide tension to the lever arm 208 and the lever arm 208 may lift the upper pole 204. In this manner, the upper pole 204 may extend generally perpendicular to the lower pole 202. In this position, the backboard 198 may be positioned on the ground adjacently below the upper pole 204 and the upper extension 206 may be coupled to the upper pole 204. The backboard 198 may be coupled to one end of the upper extension 206.

Figure 19:
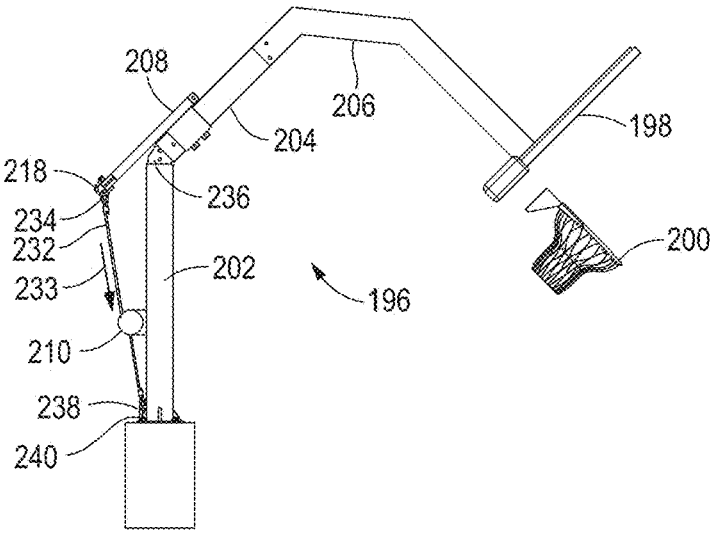
FIG. 19 is a side view of the upper pole pivotably coupled to the lower pole of the basketball system, depicting the pole assembly system lifting the upper pole to a second intermediate position for coupling a rim of the basketball system thereto, according to another embodiment of the present invention.
Figure 20:
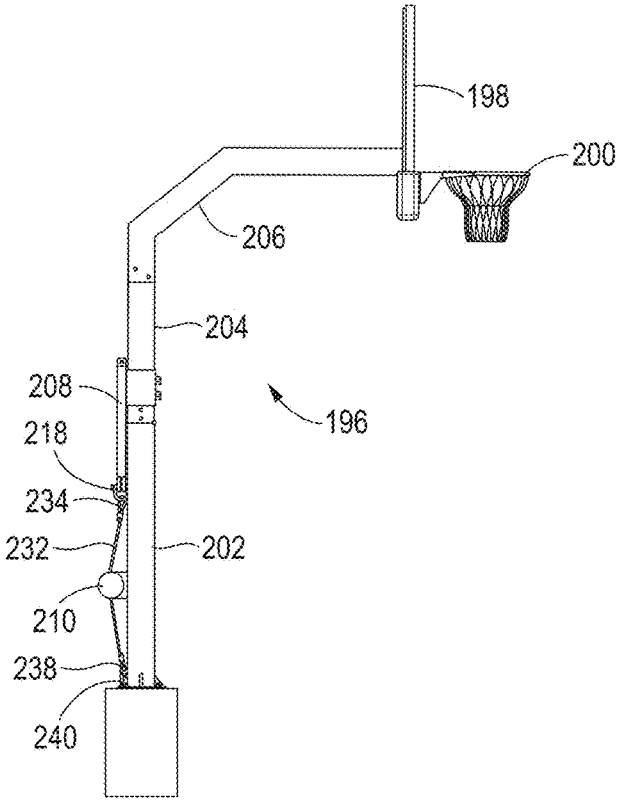
FIG. 20 is a side view of the basketball system, depicting the pole assembly system coupled to the basketball system and depicting the basketball system in a fully upright position, according to another embodiment of the present invention.

With reference to FIGS. 18 and 19, the lifting device 210 may again retract the line 232, as shown by arrow 233, to pivot and lift the upper pole 204 and upper extension 206 to a second intermediate position (FIG. 19). In this position, the lever arm 208 and the upper pole 204 may be pivoted to extend at downward angle. Further, in the second intermediate position, the rim 200 may be coupled to the backboard 198.

Figure 21:
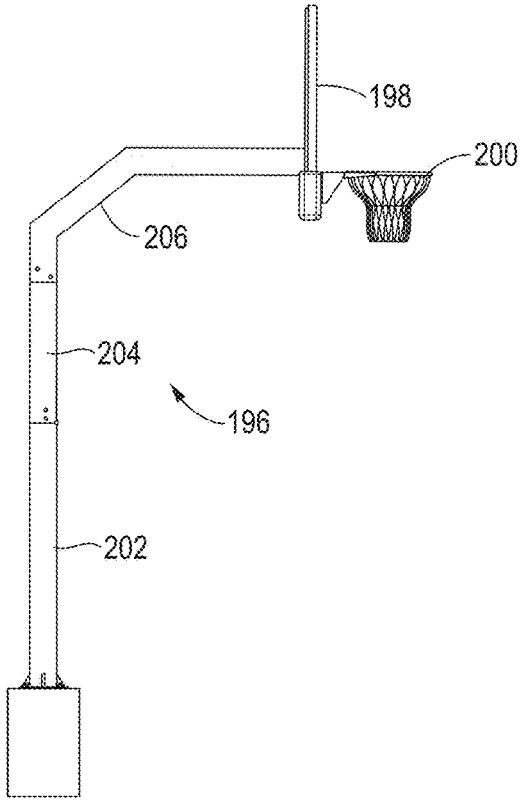
FIG. 21 is a side view of the basketball system in the upright position and depicting the pole assembly removed from the basketball system, according to another embodiment of the present invention.
Figure 22:
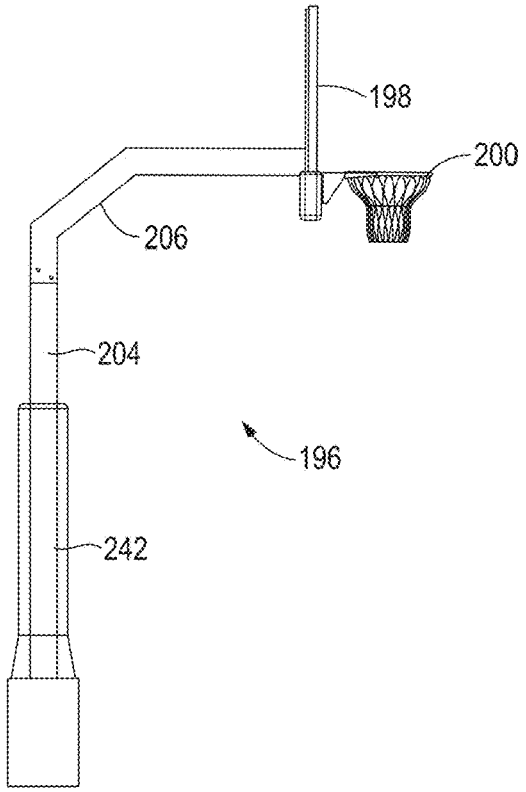
FIG. 22 is a side view of the basketball system in an upright and assembled position with a pad coupled thereto, according to another embodiment of the present invention.

Now with reference to FIGS. 19-22, with the upper extension 206, backboard 198, and rim 200 coupled to the upright portion 196, the lifting device 210 may retract the line 232 such that the upright portion 196 may be in an upright position or final position, the upper pole 204 extending vertically with the lower pole 202. The upper pole 204 may be coupled to the lower pole 202 by using pole fasteners, such as screws, nuts, bolts, and/or pins, extending through the upper pole 204 and inner flange portions 236 (FIG. 18) of the lower pole 202 to fixate the upper pole 204 in the upright vertical position. Once the upper pole 204 may be secured to the lower pole 202, the upper clip 234 of the line 232 may be uncoupled from the lever ring 218 and the lower clip 238 may be uncoupled from a base ring 240 so that the lifting device 210 may be removed from the basketball system 190. The lever arm 208 may also be removed from the upper pole 204. In this manner, the pole assembly system 192 may be removed from the basketball system 190, as depicted in FIG. 21. At this stage, the basketball system may receive a pad 242 positioned to extend around the lower pole 202 of the upright portion 196 and partially over the upper pole 204, as depicted in FIG. 22. With this arrangement, the basketball system 190 having the pivotable hinge coupling 228 therein may be assembled with a single person with the pole assembly system 192.

Figure 23:
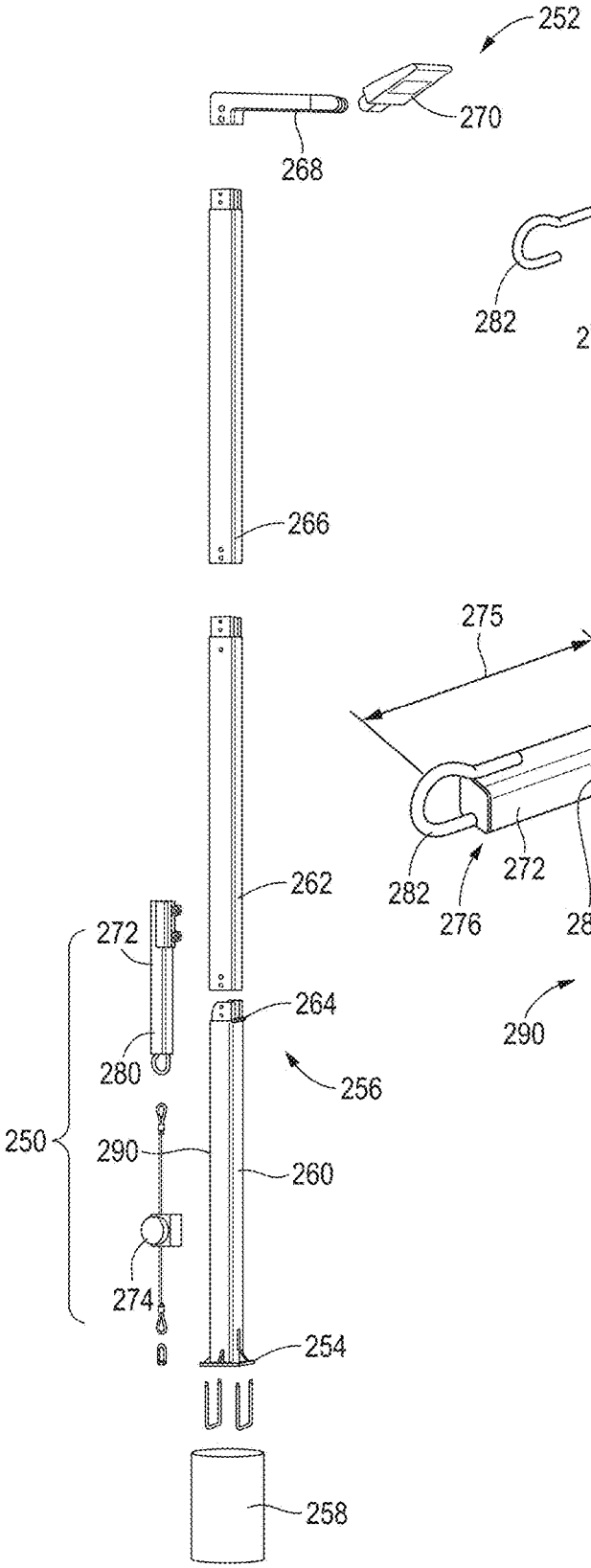
FIG. 23 is an exploded perspective view of another embodiment of a pole assembly for implementing with a light pole, according to the present invention.
Figure 29:
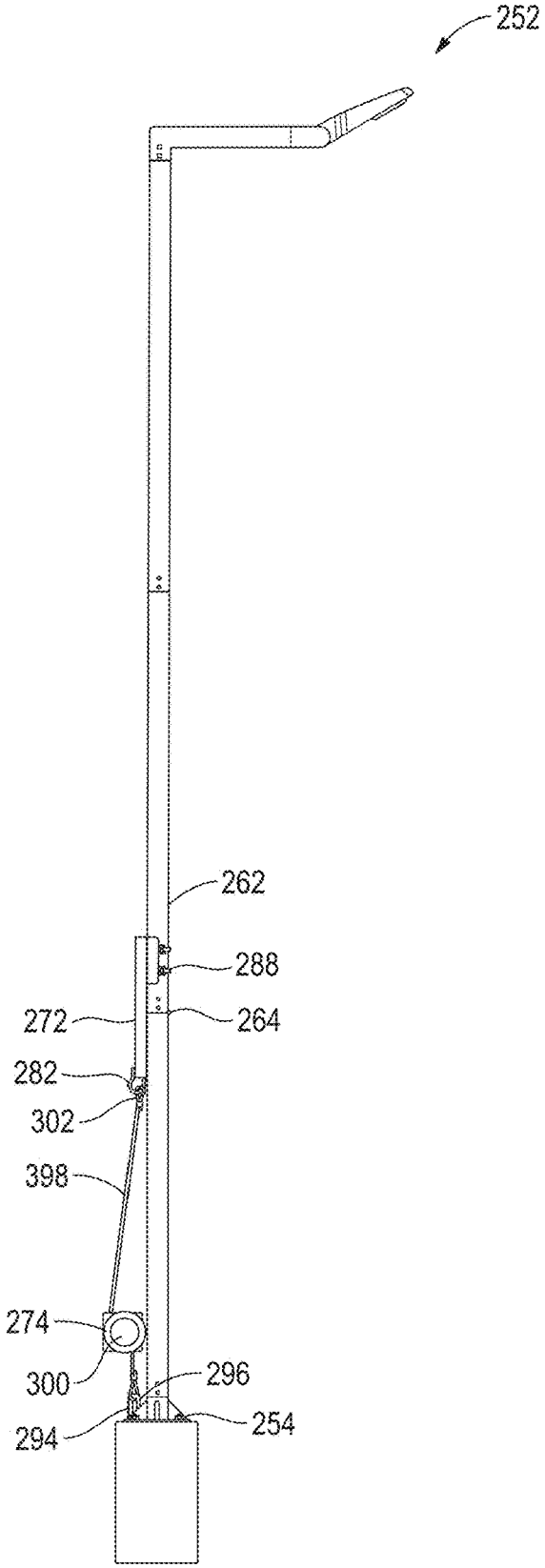
FIG. 29 is a side view of the light pole with the pole assembly system coupled thereon, depicting the light pole pivoted to the upright position, according to another embodiment of the present invention.

Now with reference to FIG. 23, another embodiment for employing a pole assembly system 250, similar to previous embodiments, to assemble a light pole 252 is provided. The light pole 252 may include similar structure to the embodiments described above by including a base portion 254 and an upright portion 256, the upright portion being the main pole of the system. The base portion 254 may be secured to a cement base 258 or cement pad. The upright portion 256 may include a lower pole 260 and an upper pole 262. The lower pole 260 may be coupled to or integrally extending from the base portion 254. The upper pole 262 may be pivotably coupled to the lower pole 260 with a hinge coupling 264, similar to previous embodiments. As such, through use of the pole assembly system 250, the upper pole 262 may be pivoted relative to the lower pole 260 from various pivoted positions (see, e.g., FIGS. 26 and 27) to an upright position (FIG. 29). The upright portion 256 may also include an upper extension 266 or a second upper pole that may be fixedly coupled to an upper end of the upper pole 262. The lower pole 260, the upper pole 262, and the upper extension 266 of the upright portion 256 may extend in a vertical manner towards an arm 268. In one embodiment, the arm 268 may be integrally coupled to, and extending from, the upper pole 262 or the upper extension 266. In another embodiment, the arm 268 may be coupled to the upper extension 266. The arm 268 may extend transverse or substantially perpendicular from the upper extension 266 towards a light head 270. The light head 270 sized and configure to provide lighting, such as LED lighting, as known to one of ordinary skill in the art.

Figure 24:
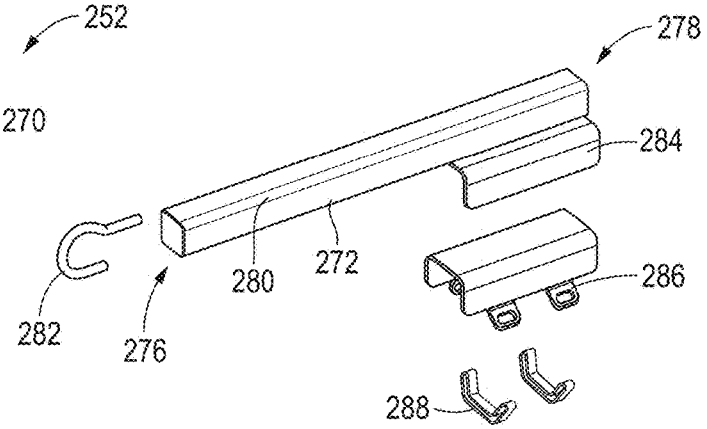
FIG. 24 is an exploded view of a lever arm of the pole assembly, according to another embodiment of the present invention.
Figure 25:
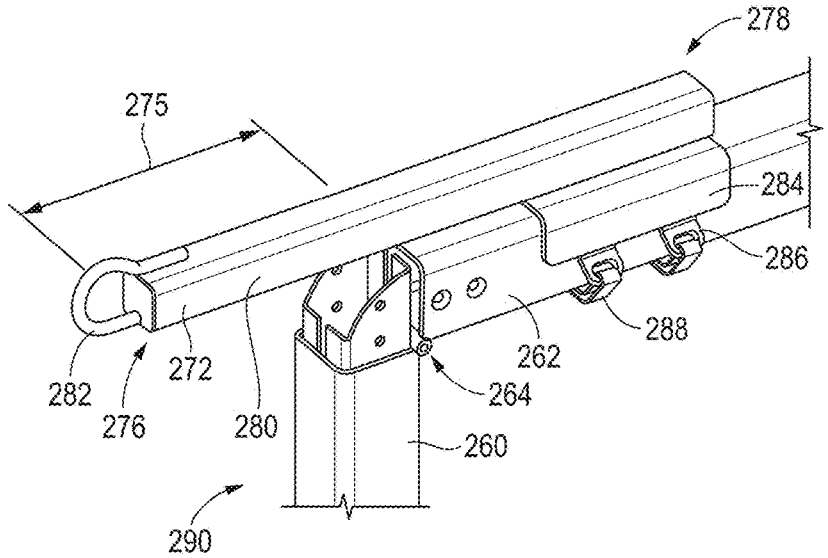
FIG. 25 is a perspective view of an upper pole pivotably coupled to a lower pole with a hinge coupling of the light pole, depicting the lever arm positioned on the upper pole, according to another embodiment of the present invention.

With reference to FIGS. 23-25, the pole assembly system 250 may include a lever arm 272 and a lifting device 274 for assembling a light pole 252. The lever arm 272 may be configured differently from that described in previous embodiments, but may maintain similar functionality in this embodiment. For example, the lever arm 272 may extend from a first end 276 to a second end 278 to define a support arm 280 with a lever ring 282 coupled to the first end 276 of the support arm 280 and a bracket 284 may be coupled adjacent to a second end 278 of the support arm 280. The support arm 280 may extend in a straight manner from the first end 276 to the second end 278. The bracket 284 of this embodiment may extend with a clasp 286 and strap 288 arrangement. The strap 288 with the clasps 286 may be sized and configured to couple the bracket 284 adjacent to a lower end of the upper pole 262, similar to previous embodiments. Further, the bracket 284 may be configured to grip or hold the lever arm 272 to the upper pole 262 such that one end of the lever arm 272 extends beyond the lower end of the upper pole 262 a distance 275 so that the lever arm 272 can act to provide mechanical advantage to pivot the upper pole 262 relative to the lower pole 260.

Figure 25A:
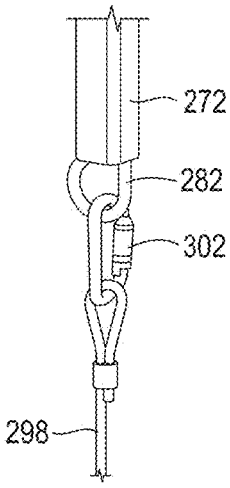
FIG. 25A is a perspective view of a coupling link, depicting a lever ring coupled to a line of the pole assembly system, according to another embodiment of the present invention.
Figure 26:
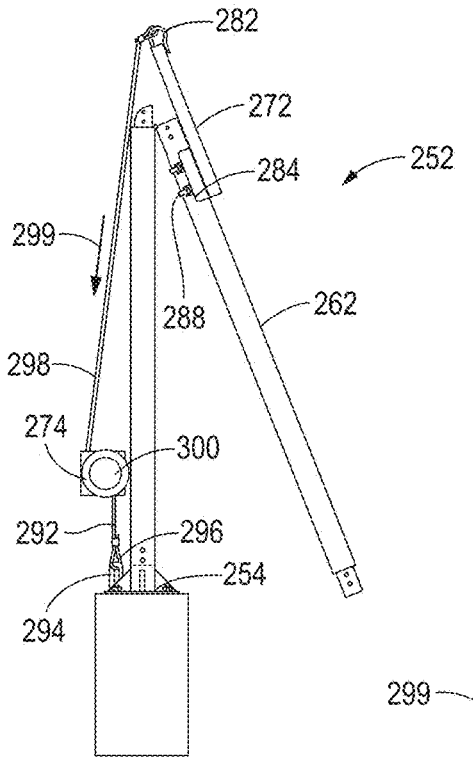
FIG. 26 is a side view of an unassembled light pole, depicting a first upper pole in a pivoted position relative to a lower pole with the pole assembly system coupled thereto, according to another embodiment of the present invention.

With reference to FIGS. 25A and 26, the lifting device 274 may be coupled to the base portion 254 of the light pole 252 with a lower line 292. The lower line 292 may couple to a base ring 294 with a lower clip 296 or other such coupling device to couple the lifting device 274 to the base portion 254. In another embodiment, the lifting device 274 may be removably coupled directly to a portion of the lower pole 260. In another embodiment, the lifting device 274 may be removably coupled to the base portion 254 or to other components set in the cement pad. Further, the lifting device 274 may include a line 298 extending from a housing 300 of the lifting device 274 to the lever ring 282 of the lever arm 272. The line 298 may be coupled to the lever ring 282 with an upper clip 302. Upon the line 298 being coupled to the lever ring 282, the lifting device 274 may be activated to place tension on the line 298 extending between the lifting device 274 and lever arm 272. As such, similar to previous embodiments, the pole assembly system 250 may be employed for pivoting the upper pole 262 and assembling the components of the light pole 252.

Figure 27:
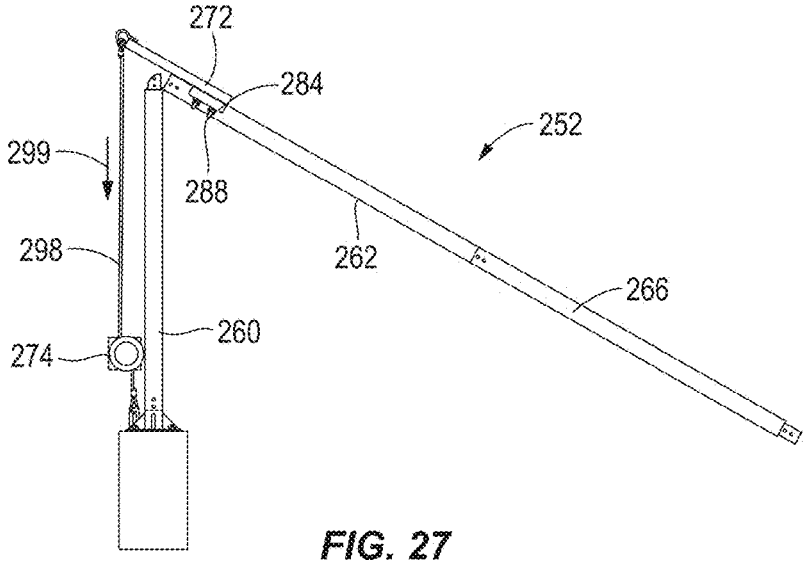
FIG. 27 is a side view of the unassembled light pole, depicting the pole assembly system pivoting the light pole to a first intermediate position and coupling a second upper pole to the first upper pole, according to another embodiment of the present invention.

Now with reference to FIGS. 26 and 27, upon securing the lower pole 260 and base portion 254 to a cement pad and pivotably coupling the upper pole 262 to the vertically extending lower pole 260, the assembly of the components of the light pole 252 will now be described. As set forth, the lever arm 272 may be coupled to the upper pole 262 and the lifting device 274 may be coupled to the base portion 254 with the lower line 292 extending to the base portion 254 of the lower pole 260 and with the line 298 extending upward from the lifting device 274 to one end of the lever arm 272, the upper pole 262 may be positioned in a pivoted position relative to the lower pole 260, as depicted in FIG. 26. The lifting device 274 may be activated to pull the line 298, as shown by arrow 299, and thus, the lever arm 272 and the upper pole 262 may be moved to a first intermediate position, as shown in FIG. 27. In the first intermediate position, the upper extension 266 or second upper pole may be fixedly coupled to the upper pole 262. Further, due to the upper pole 262 and the upper extension 266 being long, the first intermediate position of the upper pole 262 may be lifted so as to still be at an acute angle or to an angled position desired by the user, or substantially perpendicular relative to the lower pole 260. In some embodiments, the upper pole 262 may be connected to upper extension 266 prior to connecting the upper pole 262 to the lower pole 260 at the hinge coupling 264.

Figure 28:
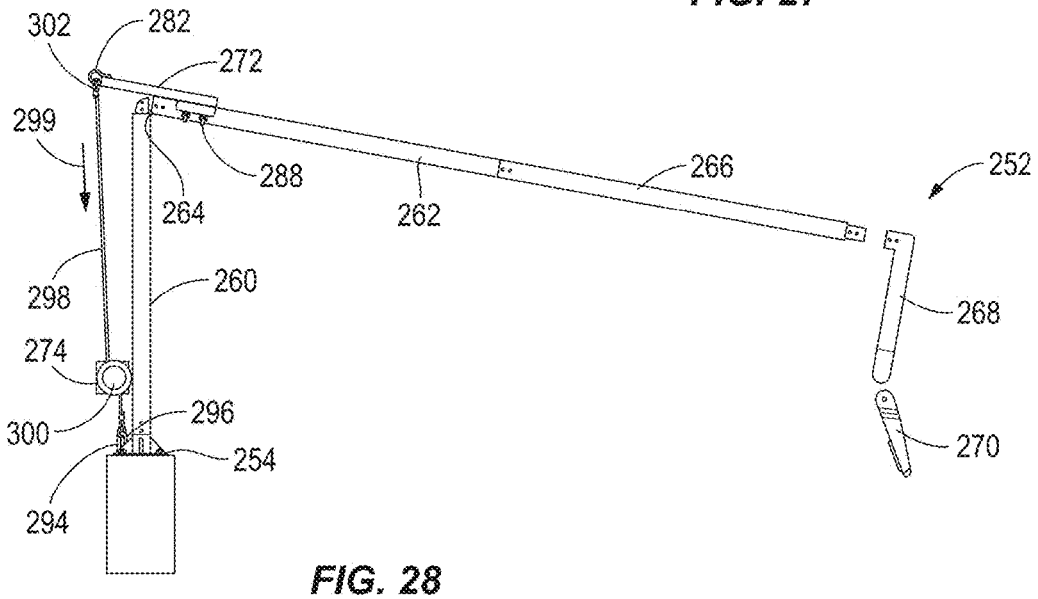
FIG. 28 is a side view of the unassembled light pole, depicting the pole assembly system lifting the first and second upper poles to a second intermediate position for coupling an arm extension and a light to one end of the second upper pole, according to another embodiment of the present invention.

With reference to FIGS. 27 and 28, once the upper extension 266 may be coupled to the upper pole 262, the lifting device 274 may be activated to retract the line 298 further, as shown by arrow 299, to a second intermediate position, as shown in FIG. 28. In the second intermediate position, the upper pole 262 and the upper extension 266 may still be pivoted to extend at an acute angle so as to not yet be perpendicular to the lower pole 260. Further, in the second intermediate position, the arm 268 and the light head 270 may be fixedly coupled to the upper extension 266. In this configuration, any other components of the light pole 252 may be coupled thereto, such as pulling electrical wire through the length of the light pole 252 such that the light pole 252 may be prepared to be completely assembled together.

Figure 30:
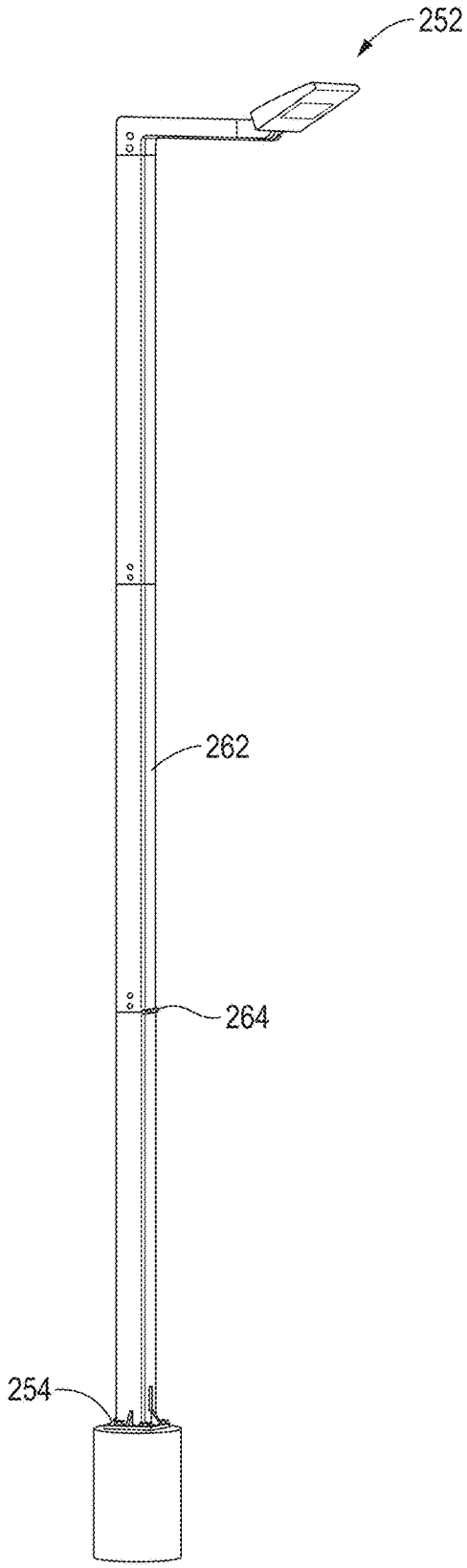
FIG. 30 is a perspective view of the light pole in the upright and assembled position with the pole assembly system removed from the light pole, according to another embodiment of the present invention.

Now with reference to FIGS. 28-30, upon assembling each of the components of the light pole 252, the lifting device 274 may be activated to continue to pull or retract the line 298 so that the lever arm 272, and thus, the upper pole 262 may be pivoted at the hinge coupling 264 to the upright position. The lower end portion of the upper pole 262 may then be fixedly coupled to the internal flange portions (similar to previous embodiments) at the top portion of the lower pole 260 so that each of the upper pole 262 and upper extension 266 may be fixed in the upright position with the lower pole 260, as depicted in FIG. 29. In the upright position, the upper clip 302 coupling the line 298 of the lifting device 274 to the lever ring 282 may be removed. The remaining line 298 of the lifting device 274 may be retracted into a housing 300 of the lifting device 274 and the lower clip 296 coupled to the base ring 294 may be undone to remove the lifting device 274 from the base portion 254 of the light pole 252. The straps 288 of the lever arm 272 may then be uncoupled from the clasps 286 (FIG. 25) and the lever arm 272 may be removed from the upper pole 262, as depicted in FIG. 30. In this manner, similar to previous embodiments of the basketball system, the light pole 252 may be assembled with the pole assembly system 250 such that a single person may assemble the light pole 252 despite the length and weight of the light pole 252. The hinge coupling 264 that pivotably couples the upper pole 262 to the lower pole 260 of this embodiment may be at a height of about five feet above the cement pad or ground level or at a height within the range between about four feet and about six feet. In another embodiment, the hinge coupling 264 that pivotably couples the upper pole 262 to the lower pole 260 of this embodiment may be at a height within the range between about four feet and about seven feet. In another embodiment, the upper pole 262 may be a length between about four feet and about seven feet or longer. The upper extension 266 may also be a length between about four feet and about seven feet or longer. Additional extensions may be added with similar length ranges such that the light pole may be at a desired height and assembled by a single person, as set forth herein.

Figure 31:
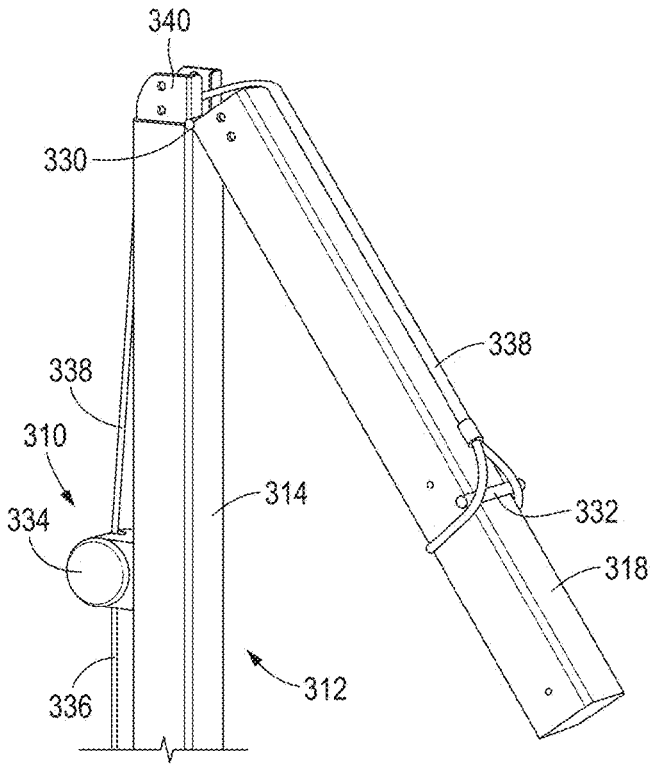
FIG. 31 is a perspective view of another embodiment of a pole assembly system, depicting a line of the pole assembly system coupled directly to an upper pole of a basketball system, according to the present invention.
Figure 32:
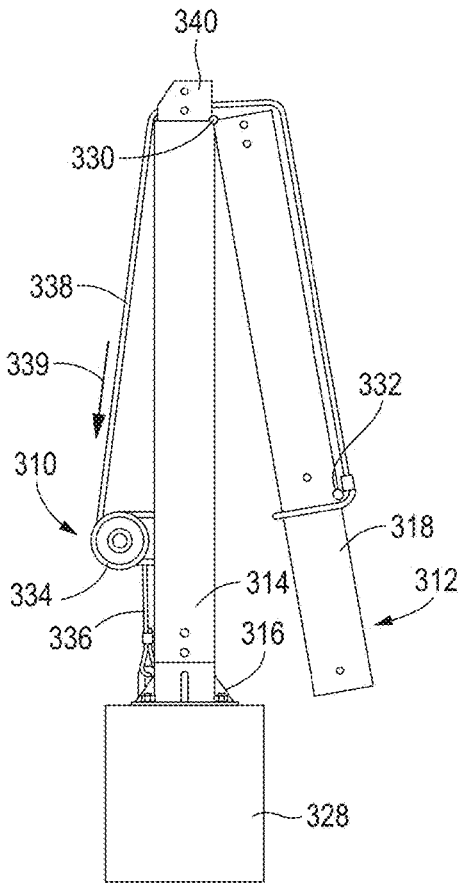
FIG. 32 is a side view of the basketball system, depicting a lifting device and lever line coupled between a base portion and the upper pole of the basketball system, according to another embodiment of the present invention.

Now with reference to FIGS. 31-35, another embodiment of a pole assembly system 310 for assembling a basketball system 312, as well as the light pole system set forth above, is provided. In this embodiment, the basketball system 312 may include similar components as set forth in previous embodiments. For example, the basketball system 312 may include a lower pole 314 with a base portion 316, an upper pole 318, link arms 320, a back board 322, a height actuator 324, and a rim 326. With reference to FIGS. 31-32, similar to that described in previous embodiments, assembly of the basketball system 312 may be initiated by securing the base portion 316 to a cement pad 328 with the lower pole 314 fixedly extending vertically upward from the base portion 316. The upper pole 318 may then be pivotably coupled to the lower pole 314 at a hinge coupling 330. In this embodiment, the upper pole 318 may include a hook device 332, which may be removably coupled to the upper pole 318. Further, in this embodiment, the pole assembly system 310 may include a lifting device 334 with a lower line 336 and an upper line 338. The pole assembly system 310 of this embodiment may not include a lever arm. The lower line 336 may be coupled to the base portion 316, similar to that described in previous embodiments. The upper line 338 of the pole assembly system 310 may extend upward along the lower pole 314 and continue to extend along some of the length of the upper pole 318 (in the pivoted position) to extend and be coupled to the hook device 332. Further, the upper line 338 may extend over the hinge coupling 330 between the lower and upper poles 314, 318 and between inner flange portions 340 of the lower pole 314. As such, the inner flange portions 340 of the lower pole 314 may assist the upper line 338 being maintained to extend over the hinge coupling 330 as well as extending over both the lower and upper poles 314, 318. The lifting device 334 of this embodiment may preferably be a motorized lifting device, but may also be a hand crank manually operated lifting device as well.

Figure 33:
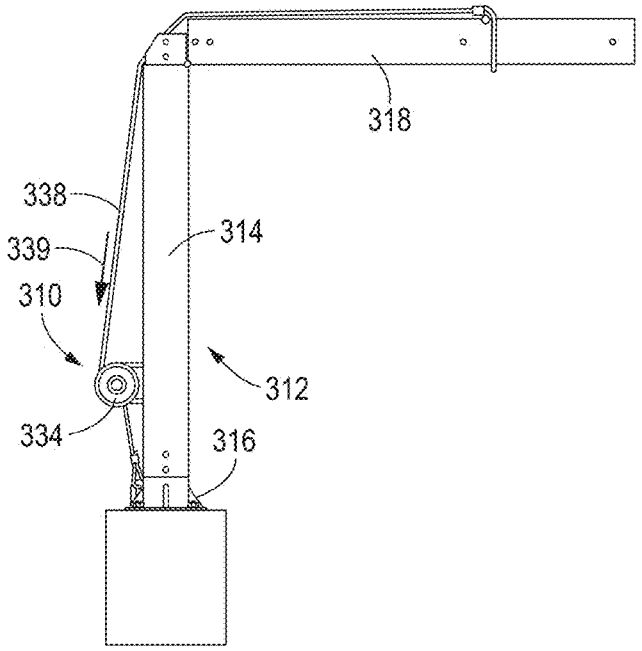
FIG. 33 is a side view of the upper pole pivotably coupled to the lower pole of the basketball system, depicting a pole assembly system pivoting the upper pole to a first intermediate position, according to another embodiment of the present invention.
Figure 34:
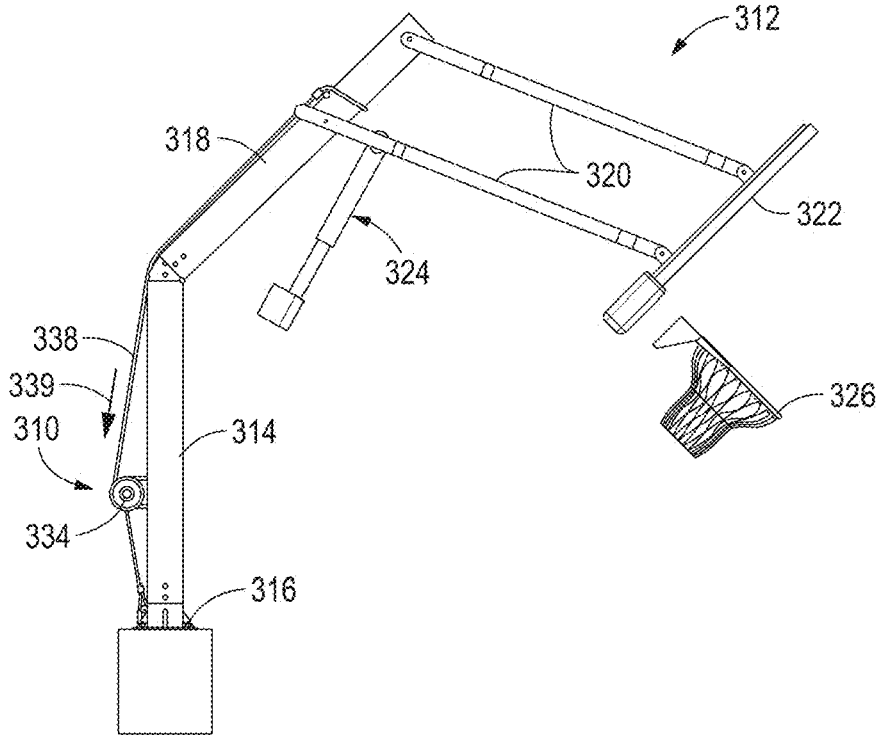
FIG. 34 is a side view of the basketball system, depicting the pole assembly system pivoting the upper pole to a second intermediate position, according to another embodiment of the present invention.
Figure 35:
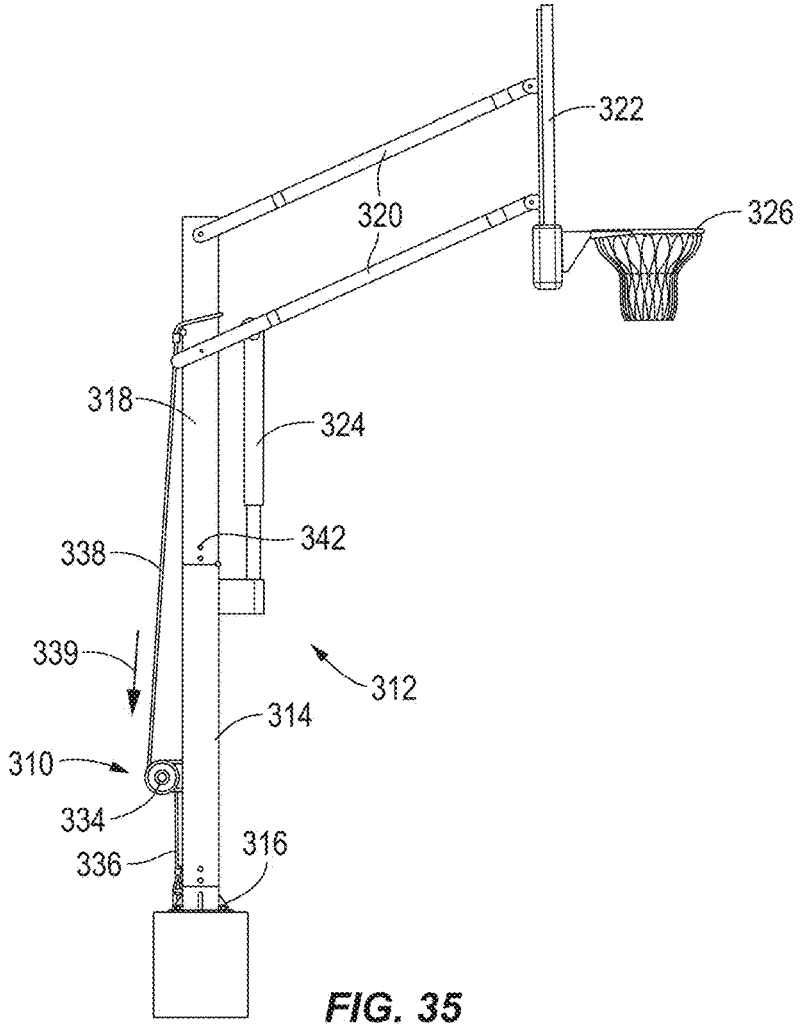
FIG. 35 is a side view of the basketball system, depicting the pole assembly system pivoting the basketball system to the upright position, according to another embodiment of the present invention.

With reference to FIGS. 32-34, the lifting device 334 may be activated to pull the upper line 338, as shown by arrow 339, and pivot the upper pole 318 to a first intermediate position. The first intermediate position may lift and pivot the upper pole 318 to extend generally parallel with the ground level or generally perpendicular relative to the lower pole 314. With reference to FIGS. 33-34, at the first intermediate position, the link arms 320 may be coupled to the upper pole 318, and the backboard 322 may also be coupled to the link arms 320, similar to that described in previous embodiments herein. Now with reference to FIG. 34, at this stage, the lifting device 334 may be activated to pull the upper line 338, as shown by arrow 339, and further pivot the upper pole 318 to extend at an obtuse angle relative to the lower pole 314 or a second intermediate position, the upper pole 318 being pivoted with each of the link arms 320 and backboard 322 coupled therewith. In the second intermediate position of the upper pole 318, the height actuator 324 may be coupled to one or more of the link arms 320 and the rim 326 may be coupled to the backboard 322. At this stage, the lifting device 334 may again be activated to pull the upper line 338, as shown by arrow 339, so that the upper pole 318 may continue to pivot to a vertically upright position with the lower pole 314, as depicted in FIG. 35. The upper pole 318 may then be fixated in the upright position by securing pole fasteners 342 adjacent the lower end of the upper pole 318 and through the inner flange portions 340 (FIG. 32) at a top portion of the lower pole 314. The lifting device 334 and lower and upper lines 336, 338 may then be removed from the respective base portion 316 and the upper pole 318. In this manner, the basketball system 312 (as well as a light pole system) may be assembled using the pole assembly system 310. Such pole assembly system 310, as well as any of the pole assembly systems described herein, may be implemented with any suitable pole system, such as the described basketball systems and light pole system, that may be implemented with an upper pole that is pivotably coupled to a lower pole. Such pivotable connection may be temporary for the assembly process. Upon completing the assembly process, the upper pole may then be fixated in the upright position relative to the vertically extending lower pole. In this manner, the various embodiments of a pole assembly system may be implemented for assembling various types of pole structures with the difficulty minimized by the assembly system and the pole structure including sections pivotably coupled to each other, as described herein.

Figure 36:
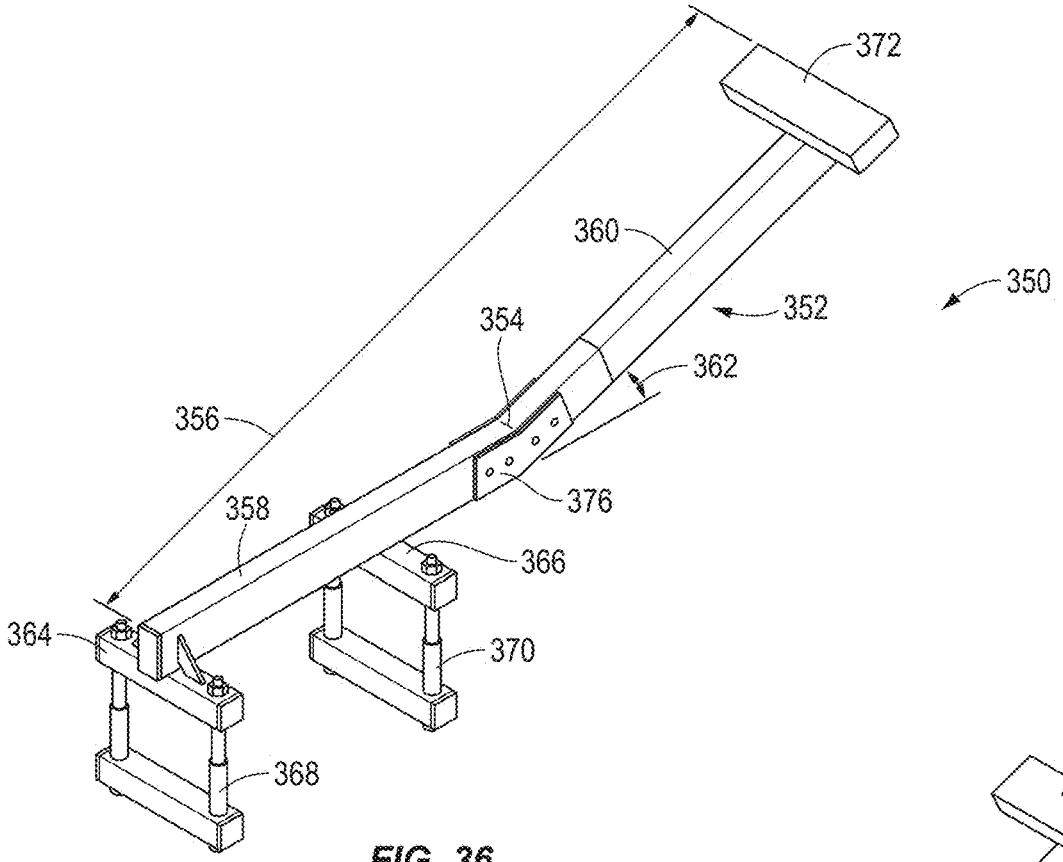
FIG. 36 is a perspective view of another embodiment of a lever, depicting coupling members associated with the lever, according to the present invention.
Figure 37:
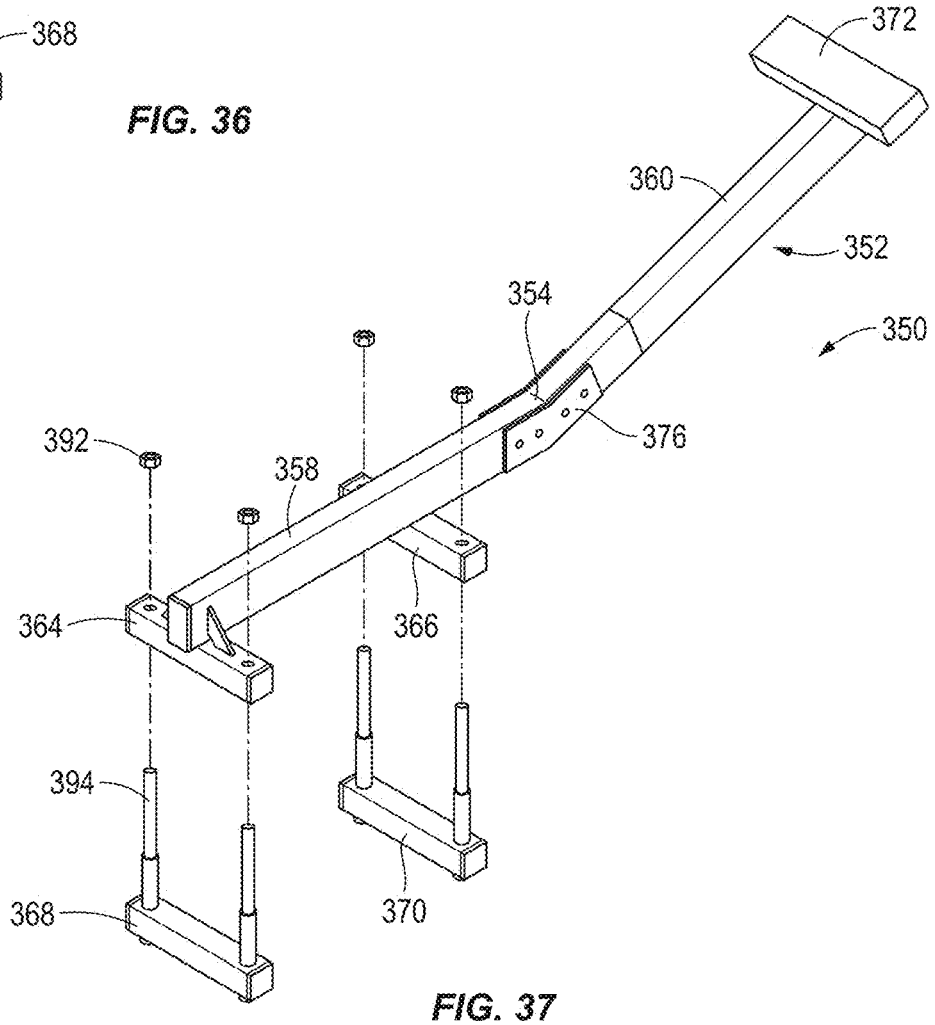
FIG. 37 is a partially exploded view of the lever, depicting portions of the coupling members of the lever dis-assembled, according to an embodiment of the present invention.

Further, with reference to FIGS. 36 and 37, another embodiment of a lever arm 350 is provided. Such lever arm 350 may be employed with any one of the basketball standards or basketball goals set forth herein as well as any one of the light poles set forth herein. In this embodiment, the lever arm 350 may include an elongated structure 352 with a bend 354 or at least one bend along a length 356 of the elongated structure 352, similar to the embodiment set forth in FIGS. 3 and 4. Further, the lever arm 350 may include a first elongated portion 358 and a second elongated portion 360 that may define the bend 354 therebetween such that the first elongated portion 358 may extend at an angle 362 relative to the second elongated portion 360. The first elongated portion 358 may include a first coupling member 364 and a second coupling member 366 both fixed thereto and spaced apart. The first coupling member 364 may be sized and configured to couple to a first u-frame 368 and the second coupling member 366 may be sized and configured to couple to a second u-frame 370. With this arrangement, the first and second u-frames 368, 370 may be sized and configured to act as a coupling bracket with the respective first and second coupling member 364, 366 so that the lever arm 350 may be temporarily coupled to an upper portion of a basketball standard (see FIG. 42). The second elongated portion 360 may include a transverse member 372 fixed adjacent to a free end 374 (FIG. 41) of the second elongated portion 360, the transverse member 372 being elongated to extend transverse relative to the second elongated portion 360. The second elongated portion 360 may extend at the angle 362 relative to the first elongated portion 358 such that the bend 354 defined by the angle 362 may at least partially define or distinguish the first and second elongated portions 358, 360. The first and second elongated portions 358, 360 may be coupled together with one or more plates 376, the one or more plates 376 positioned on one or opposite sides of the first and second elongated portions 358, 360. In another embodiment, the first and second elongated portions 358, 360 may extend with a bend portion therebetween such that the first and second elongated portions are formed as a single piece.

Figure 42:
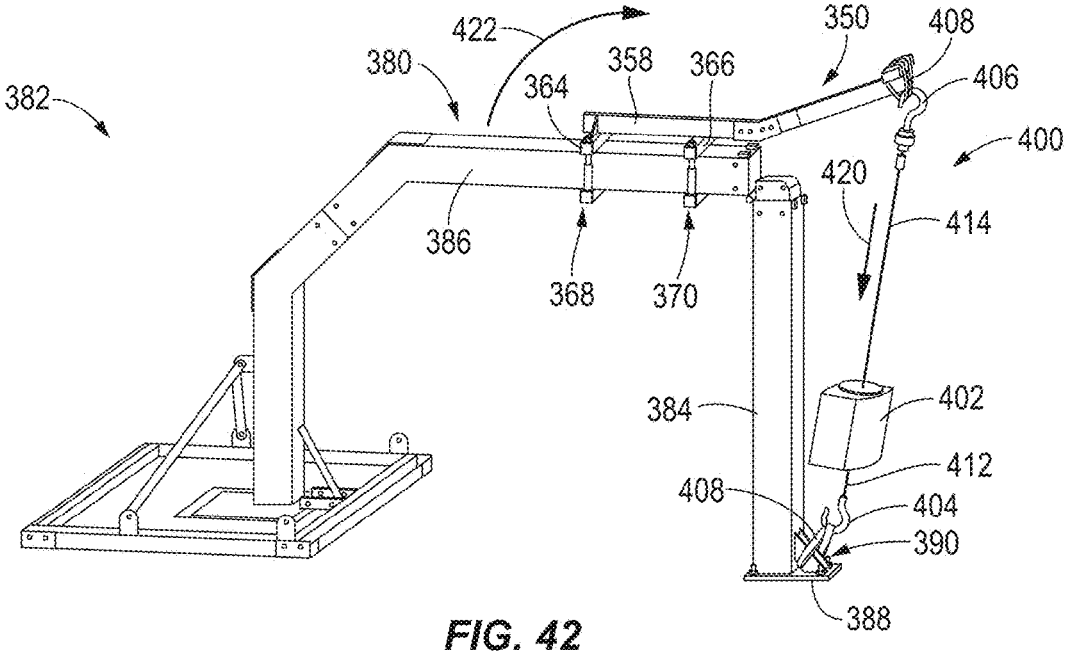
FIG. 42 is a perspective view of the pole assembly in a partially dis-assembled position, depicting a lifting device assembly coupled to the lever and the base of the pole assembly, according to another embodiment of the present invention.

Now with reference to FIGS. 37 and 42, the lever arm 350 may be attached to a pole assembly 380, such as the pole assembly 380 for a basketball standard 382. For example, the pole assembly 380 of the basketball standard 382 may include a lower pole 384 pivotably coupled with a hinge coupling 385 to an upper pole 386, the lower pole 384 secured to a cement footing (not shown) via a base plate 388 at a base 390 of the pole assembly 380, as previously set forth herein. The upper portion or upper pole 386 of the basketball standard 382 may be assembled to the remaining portion of the basketball standard 382. The first elongated portion 358 of the lever arm 350 may be temporarily coupled to the upper pole 386 of the basketball standard 382 with the first and second u-frames 368, 370 positioned along one side of the upper pole 386 and coupled with bolts 392 to the first and second coupling members 364, 366 of the lever arm 350. The bolts 392 may be tightened over arms 394 of the first and second u-frames 368, 370 to secure the lever arm 350 to the upper pole 386.

Figure 38:
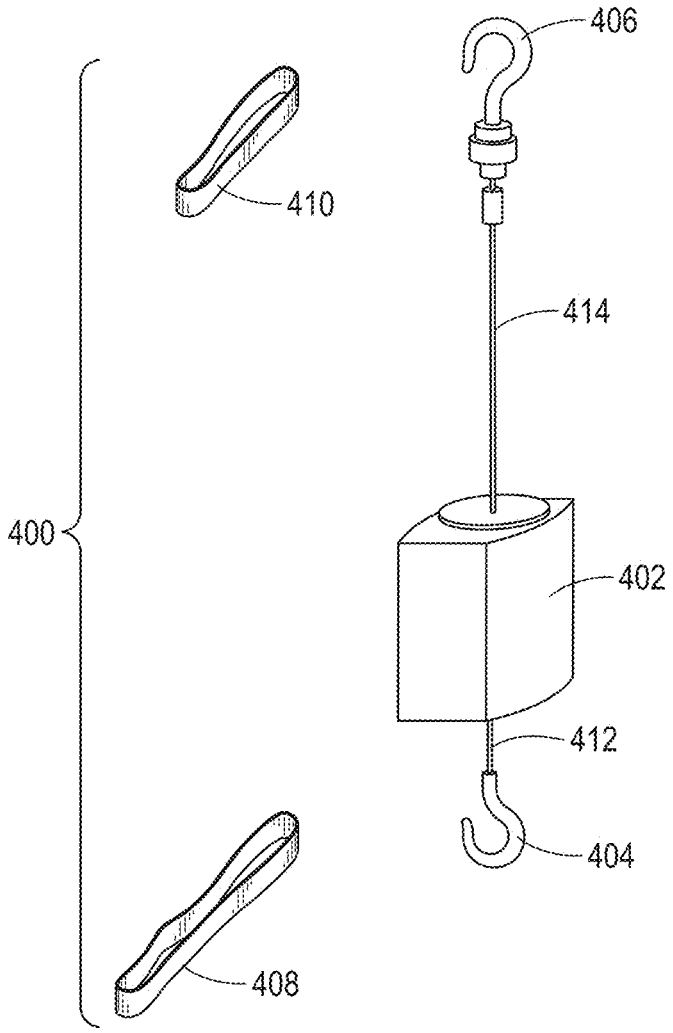
FIG. 38 is a partially exploded view of a lifting device assembly, according to an embodiment of the present invention.

With reference to FIGS. 38 and 42, with the lever arm 350 coupled to the upper pole 386 of the pole assembly 380, a lifting device assembly 400 may be coupled to the lever arm 350. Such lifting device assembly 400 may include a lifting device 402 (such as a winch or hoist), one or more lines and a first hook 404 and a second hook 406. Further, the lifting device assembly 400 may be coupled to the base 390 of the pole assembly 380 and the lever arm 350 with a first strap 408 and a second strap 410, respectively. The first and second straps 408, 410 may be in the form of a loop and may be a webbed strap material. The one or more lines may include a first line 412 and a second line 414. The first line 412 may extend from one end of the lifting device 402 and may be fixed thereto. The first line 412 may also be interconnected to the first hook 404. The second line 414 may extend from one end of the lifting device 402, such as the opposite end of the lifting device 402 relative to the first line 412. The second line 414 may be movable or wind into and out of the lifting device 402 via a motor (not shown) of the lifting device 402, as known to one of ordinary skill in the art. Further, the second line 414 may be coupled to the second hook 406. Further, as in previous embodiments, the lifting device 402 may be an electric motorized lifting device or the lifting device may be manually driven with a crank.

Figure 39:
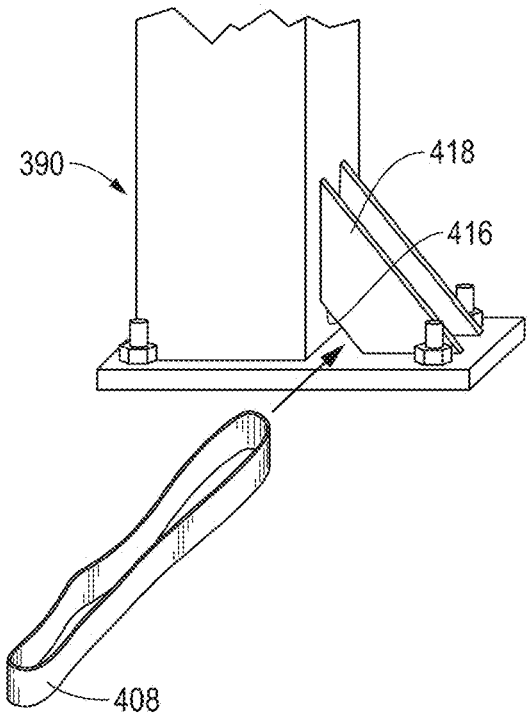
FIG. 39 is a perspective view of a base of a pole assembly, depicting an opening defined in the base configured to receive a strap of the lifting device assembly, according to another embodiment of the present invention.
Figure 40:
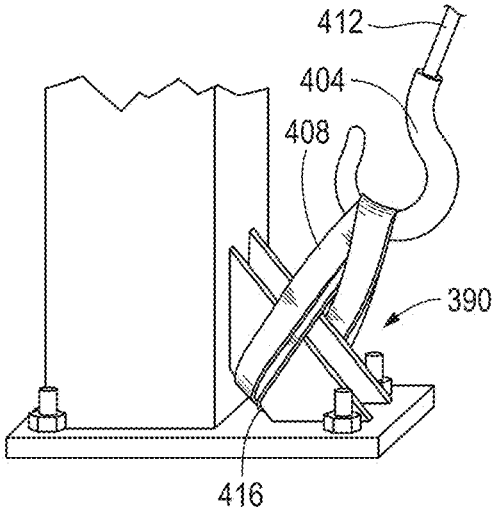
FIG. 40 is a perspective view of the base of the pole assembly, depicting the strap coupling a hook of the lifting device assembly to the base of the pole assembly, according to another embodiment of the present invention.
Figure 41:
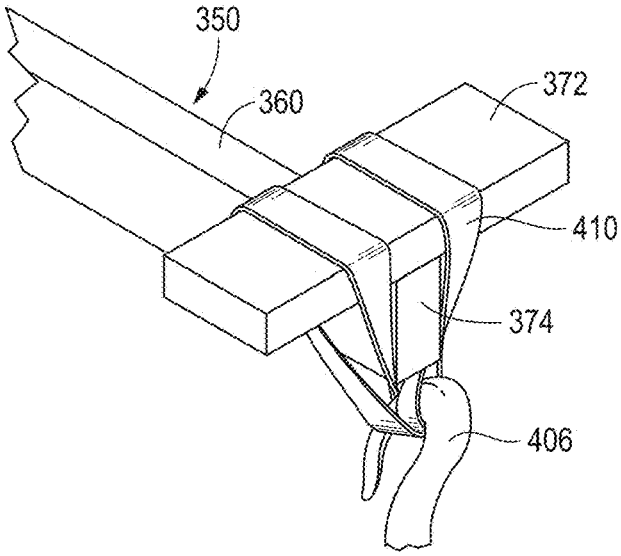
FIG. 41 is a perspective view of a portion of the lever, depicting another strap coupling another hook of the lifting device assembly to the lever, according to another embodiment of the present invention.

With respect to FIGS. 39-42, the lifting device assembly 400 may be coupled to the base 390 of the pole assembly 380 and the lever arm 350 with the first and second straps 408, 410. For example, as depicted in FIG. 39, the first strap 408 may extend through an opening 416 defined in the base 390 or adjacent the base 390, such as under braces 418 of the base 390. Upon the first strap 408 being positioned within or through the opening 416 defined in the base 390, the first hook 404 may be coupled to the first strap 408, as depicted in FIG. 40. In this manner, the first line 412 of the lifting device assembly 400 may be coupled to the base 390 of the pole assembly 380 with the first strap 408. As depicted in FIG. 41, the second strap 410 may be wrapped around the transverse member 372 of the second elongated portion 360 of the lever arm 350 so that the second hook 406 may be coupled to the second strap 410. With this arrangement, the first and second hooks 404, 406 may readily be attached to the pole assembly 380 and the lever arm 350, as depicted in FIG. 42.

Figure 43:
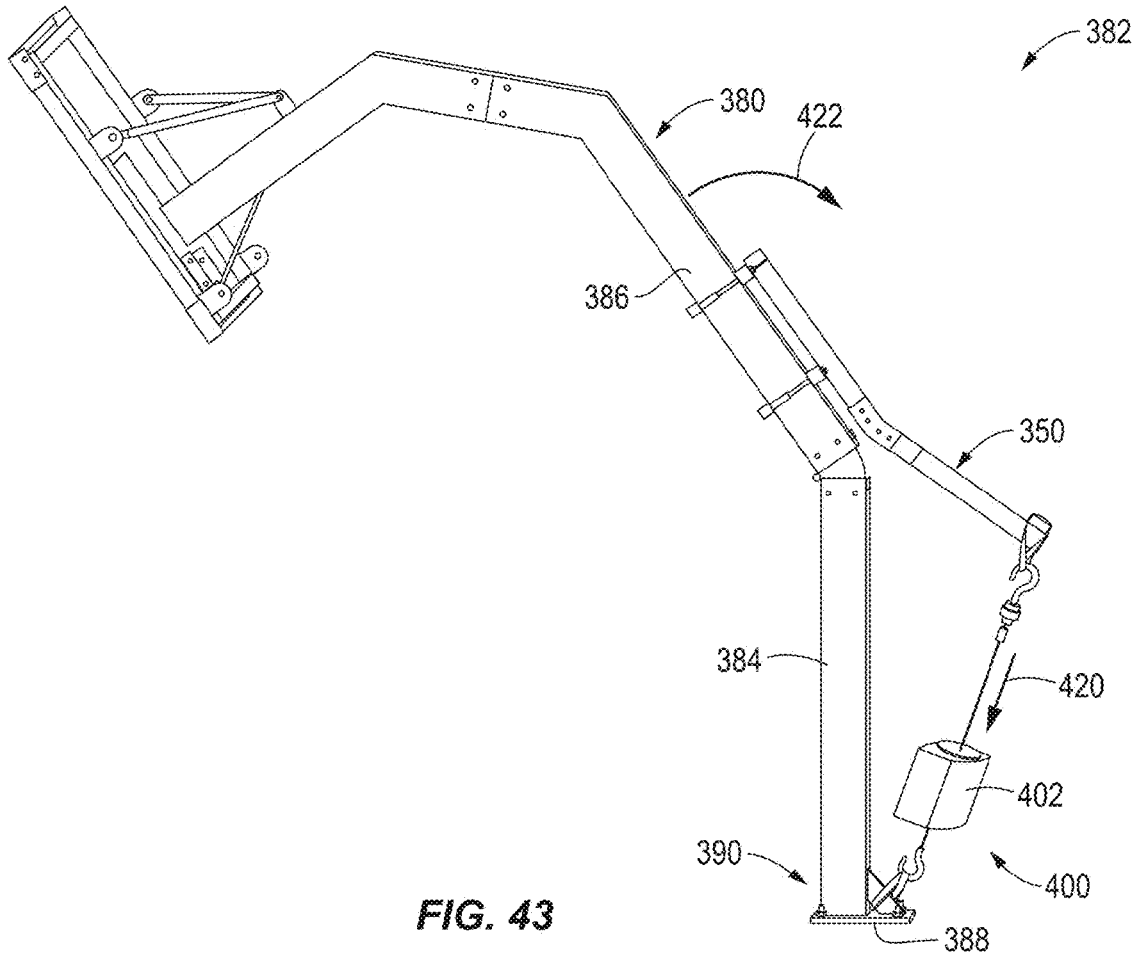
FIG. 43 is a perspective view of the pole assembly being drawn toward a vertical position with the lifting device assembly and the lever, according to another embodiment of the present invention.

Now with reference to FIGS. 42 and 43, upon the lever arm 350 being coupled to the upper pole 386 of the pole assembly 380 and the lifting device assembly 400 being coupled to the lever arm 350 and to the base 390 or adjacent the base plate 388 of the pole assembly 380, the lifting device 402 may be activated to pull downward with a force on the one end of the lever arm 350, as shown by arrow 420. As depicted, as the lifting device 402 places the force on the lever arm 350, the upper pole 386 may pivot at the hinge coupling 385 between the lower and upper poles 384, 386 so that the upper pole 386 pivots, as shown by rotational arrow 422. As in previous embodiments, the lifting device 402 may continue to place a force on the one end of the lever arm 350 until the upper pole 386 extends vertically with the lower pole 384, as described and depicted in previous embodiments.

Figure 44:
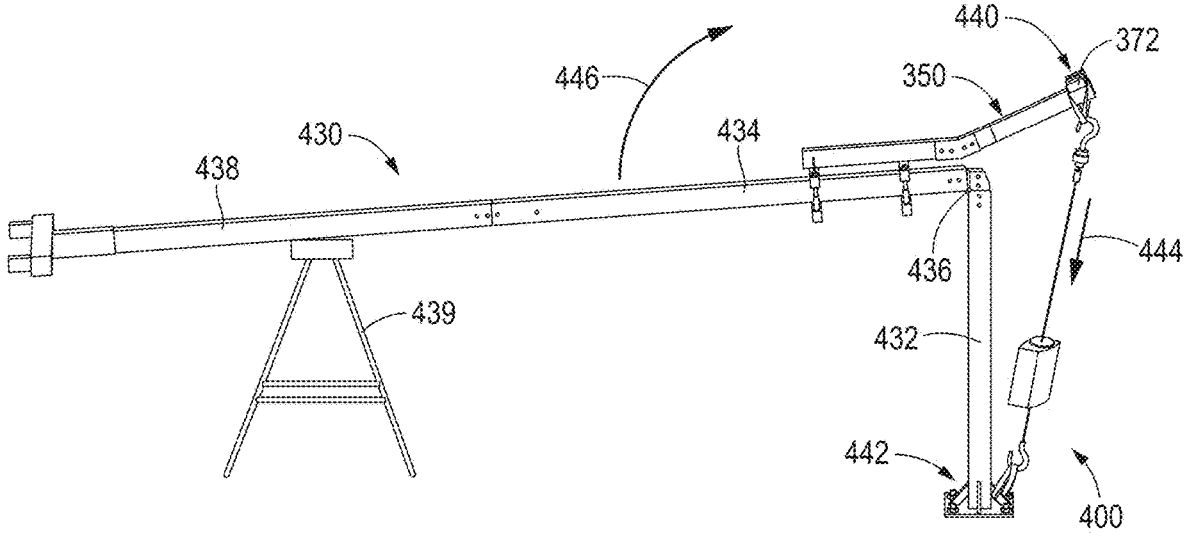
FIG. 44 is a perspective view of another embodiment of a pole assembly, depicting the lifting device assembly and the lever coupled to the pole assembly, according to the present invention.

With reference to FIGS. 37, 38 and 44, the lever arm 350 and the lifting device assembly 400 previously described may be readily employed with a light pole assembly 430, similar to that described in previous embodiments herein. For example, the light pole assembly 430 may include a lower pole 432 and an upper pole 434 with a hinge coupling 436 therebetween, similar to previous embodiments. The pole assembly 430 may include one or more additional upper pole segments 438 or referenced as an extension pole piece for increased height in the assembled light pole. Similar to the previous embodiment, the lever arm 350 may be coupled to an upper portion or the upper pole 434 of the light pole assembly 430. The lifting device assembly 400 may be coupled to an end portion 440, such as the transverse member 372, of the lever arm 350 and may be coupled to a base 442 of the lower pole 432 of the light pole assembly 430. The lifting device 402 may then be activated to pull the lever arm 350 downward, as shown by arrow 444. Such downward movement of the lever arm 350 pivots or rotates the upper pole 434 upward, as shown by rotational arrow 446, via the hinge coupling 436 of the light pole assembly 430 so that the upper pole 434 of the light pole assembly 430 can be moved to a substantially vertical position with the lower pole 432, similar to that depicted in FIG. 29. As depicted in FIG. 44, the light pole assembly (or basketball goal as it may be) may be assembled with assistance of a support structure 439. Such support structure 439 or other similar structure may be employed with any one of the pole assemblies or structures set forth herein to assist in pivoting one upper pole to a vertical position relative to a lower pole, as set forth herein in the various embodiments.

The various structural components of the embodiments of the basketball system, light pole, and the pole assembly system and/or lifting device assembly set forth herein may be formed from metallic materials, such as stainless steel, aluminum, copper, or any other suitable metallic material, or some components may be formed from one or more polymeric materials as well as any other materials needed to form and manufacture the various components of the basketball system, light pole, pole assembly system or lifting device assembly, as known by one of ordinary skill in the art. Further, the structural components of the basketball system, light pole, and pole assembly system may be formed by employing known manufacturing techniques and processes, such as welding, molding, milling, drilling, bending, fastening, soldering, etc., as known to one of ordinary skill in the art.

While the invention may be susceptible to various modifications and alternative forms, specific embodiments have been shown by way of example in the drawings and have been described in detail herein. Further, the structural features of any one embodiment disclosed herein may be combined or replaced by any one of the structural features of another embodiment set forth herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A basketball goal configured to be coupled to a cement pad, comprising:

a lower pole extending from a base portion such that the base portion is configured to be coupled to the cement pad, the lower pole having a lower pole hinge adjacent one end of the lower pole;

an upper pole having an upper pole hinge, the upper pole hinge configured to be coupled to the lower pole hinge with a pin to facilitate temporarily pivotably coupling the upper pole to the lower pole;

a backboard configured to be coupled to the upper pole; and a rim configured to be coupled to the backboard.

2. The basketball goal of claim 1, wherein, upon the upper pole moving from a pivot position to an upright vertical position, the upper pole is configured to be fixated to the lower pole in a non-pivotably manner so that the lower pole and the upper pole both extend vertically upright.

3. The basketball goal of claim 2, wherein the upper pole is fixated to the lower pole to form a single vertically extending pole, the upper pole fixated to the lower pole at an intermediate position along a height of the single vertically extending pole, the intermediate position being within the range of between about two feet and about eight feet from the cement pad.

4. The basketball goal of claim 1, further comprising link arms extending between a first end portion and a second end portion, the first end portion pivotably coupled to the upper pole and the second end portion coupled to the backboard.

5. The basketball goal of claim 4, further comprising a height actuator, the height actuator coupled to the link arms and one of the upper pole and the lower pole, the height actuator configured to pivot the link arms relative to the upper pole to change a height of the rim relative to the cement pad.

6. The basketball goal of claim 1, wherein the upper pole comprises a first upper pole portion and a second upper pole portion, the first upper pole portion extending straight and the second upper pole portion extending with at least one bend or at least one curved portion.

7. A pole assembly system for assembling a vertically extending pole, the pole including an upper pole configured to be pivotably coupled to a lower pole such that the lower pole includes a base portion configured to be fixed to a cement base, the pole assembly system comprising:

a lever arm coupled to the upper pole; and a lifting device coupled to the base portion of the lower pole, the lifting device coupled to the lever arm with a line such that, upon actuating the lifting device, the lifting device is configured to lift the upper pole from a pivoted position to a vertical use position so that the upper pole is positioned vertically relative to the lower pole.

8. The pole assembly system of claim 7, wherein the lever arm is removably coupled to the upper pole.

9. The pole assembly system of claim 7, wherein the lifting device is actuated with a motor associated with the lifting device.

10. The pole assembly system of claim 7, wherein the lifting device is manually actuated with a hand crank.

11. The pole assembly system of claim 7, wherein the lever arm extends with at least one bend along a length thereof.

12. The pole assembly system of claim 7, wherein the lever arm is configured to be coupled to the upper pole so that the lever arm extends over and beyond a pivot axis defined between the upper pole and the lower pole.

13. A method for assembling a pole system to a cement pad, the method comprising:

providing a pole system including an upper pole configured to be pivotably coupled to a lower pole such that the lower pole includes a base portion configured to be coupled to the cement pad;

securing the base portion and the lower pole to the cement pad such that the lower pole extends in a vertical upright position from the cement pad;

pivotably coupling the upper pole to the lower pole;

coupling a lifting device to the base portion of the lower pole;

coupling a lever arm to the upper pole with the upper pole being in a pivoted position relative to the lower pole;

coupling a line of the lifting device to the lever arm; and actuating the lifting device to pivot the upper pole toward the lower pole with the line such that the lifting device and line moves the upper pole from the pivoted position toward a vertical use position.

14. The method according to claim 13, wherein the actuating the lifting device comprises pivoting the upper pole to an intermediate position to connect a first end portion of link arms to the upper pole and a second end portion of the link arms to a backboard.

15. The method according to claim 14, wherein the actuating the lifting device comprises pivoting the upper pole to another intermediate position to connect a rim to the backboard.

16. The method according to claim 14, further comprising connecting a height actuator between one of the upper pole and lower pole and one of the link arms.

17. The method according to claim 13, wherein the actuating the lifting device comprises pivoting the upper pole to extend vertically from the lower pole in the vertical upright position for securing the upper pole to the lower pole to be maintained in the vertical upright position.

18. The method according to claim 17, further comprising removing the lever arm and the lifting device from the pole system.

19. The method according to claim 13, wherein the actuating the lifting device comprises pivoting the upper pole to an intermediate position to connect a backboard to the upper pole, and pivoting the upper pole to another intermediate position to connect a rim to the backboard.

20. The method according to claim 13, wherein the actuating the lifting device comprises pivoting the upper pole to an intermediate position to connect a light member to the upper pole.

21. The method according to claim 13, wherein the actuating the lifting device comprises actuating the lifting device with a motor associated therewith.

22. The method according to claim 13, wherein the actuating the lifting device comprises manually actuating the lifting device with a hand crank associated therewith.

23. The method according to claim 13, wherein the coupling of the lever arm comprises coupling the lever arm with at least one bend along a length of the lever arm.

24. A pole assembly system for securement to a cement pad, comprising:

a pole assembly including an upper pole and a lower pole, the lower portion including a base portion such that the base portion is configured to be coupled to the cement pad, the lower pole configured to extend from the base portion such that the lower pole extends in an upright vertical position, the upper pole configured to be pivotably coupled to the lower pole;

a lever arm configured to be coupled to the upper pole; and a lifting device configured to be coupled to the base portion of the lower pole, the lifting device coupled to the lever arm with a line such that, upon actuating the lifting device, the lifting device is configured to lift the upper pole from a pivoted position to a vertical use position so that the upper pole is positioned vertically relative to the lower pole.

25. The pole assembly system of claim 24, wherein the pole assembly further comprises link arms, a backboard, a rim, and a height actuator, the link arms configured to be coupled to the upper pole and the backboard, the rim configured to be coupled to the backboard, and the height actuator configured to be coupled to the upper pole and at least one link arm.

26. The pole assembly system of claim 24, wherein the pole assembly further comprises a backboard and a rim, the backboard configured to be coupled to the upper pole, and the rim configured to be coupled to the backboard.

27. The pole assembly system of claim 24, wherein the pole assembly further comprises a light member.

28. The pole assembly system of claim 24, wherein the lifting device is manually actuated with a hand crank.

29. The pole assembly system of claim 24, wherein the lever arm is removably coupled to the upper pole with a strap.

30. The pole assembly system of claim 24, wherein the lever arm extends with at least one bend along a length thereof.

31. The pole assembly system of claim 24, wherein the lever arm is configured to be coupled to the upper pole so that the lever arm extends over and beyond a pivot axis defined between the upper pole and the lower pole.

32. A light pole configured to be coupled to a cement pad, comprising:

a lower pole extending between a base end and an upper end, the base end secured to the cement pad so that the lower pole is fixed in a substantially vertical position, the lower pole including a lower pole hinge adjacent to the upper end of the lower pole;

an upper pole extending between first and second ends, the upper pole having an upper pole hinge positioned adjacent to the first end of the upper pole, the upper pole hinge configured to be coupled to the lower pole hinge with a pin to facilitate temporarily pivotably coupling the upper pole to the lower pole; and a light fixture operably coupled to the upper pole.

33. The light pole of claim 32, further comprising a second upper pole extending between opposing ends, one end of the second upper pole coupled to the second end of the upper pole and another one end of the second upper pole coupled adjacent the light fixture.

34. The light pole of claim 32, further comprising a second upper pole and an extension member, the second upper pole configured to be coupled to the second end of the upper pole, the extension member coupled to one end of the second upper pole and extending transverse relative to the second upper pole, the light fixture being coupled to the extension member.

35. The light pole of claim 32, further comprising an extension member coupled to the second end of the upper pole and extending transverse relative to the upper pole, the light fixture coupled to the extension member.

36. The light pole of claim 32, wherein the lower pole comprises inner flange portions extending from adjacent the upper end of the lower pole and configured to be positioned within the upper pole adjacent the first end of the upper pole, wherein, upon pivoting the upper pole from a pivoted position to an upright position, the upper pole is configured to be coupled to the inner flange portions of the lower pole so that the upper pole is fixed in an upright position with the vertically positioned lower pole.

* * * * *